US005480152A

United States Patent [19]

Schmidt et al.

[11] Patent Number: 5,480,152

[45] Date of Patent: Jan. 2, 1996

[54] HOLLOW, METALLIC GOLF CLUB HEAD WITH RELIEVED SOLE AND DENDRITIC STRUCTURES

[75] Inventors: Glenn H. Schmidt, Malibu; Richard C. Helmstetter, Carlsbad, both of Calif.

[73] Assignee: Callaway Golf Company, Carlsbad, Calif.

[21] Appl. No.: 173,389

[22] Filed: Jan. 6, 1994

Related U.S. Application Data

[63] Continuation-in-part of Ser. No. 29,553, Mar. 11, 1993, Pat. No. 5,301,945, which is a continuation of Ser. No. 819,379, Jan. 15, 1992, Pat. No. 5,240,252, which is a continuation-in-part of Ser. No. 791,322, Nov. 14, 1991, Pat. No. 5,180,166, which is a continuation of Ser. No. 595,963, Oct. 16, 1990, Pat. No. 5,067,715.

[51] Int. Cl.[6] ..... A63B 53/04

[52] U.S. Cl. ..... 273/167 A; 273/174

[58] Field of Search ..... 273/167 A–167 E, 273/167 G, 167 H, 167 K, 172, 174, 167 F

[56] References Cited

U.S. PATENT DOCUMENTS

| | | | |
|---|---|---|---|
| D. 94,549 | 2/1935 | Jansky . | |
| D. 225,419 | 12/1972 | Mills . | |
| D. 307,783 | 5/1990 | Iinuma . | |
| D. 318,087 | 7/1991 | Helmstetter . | |
| 1,167,106 | 1/1916 | Palmer . | |
| 1,568,888 | 1/1926 | Dunn . | |
| 1,582,836 | 4/1926 | Link . | |
| 1,619,566 | 3/1927 | Crankshaw . | |
| 1,658,581 | 2/1928 | Tobia . | |
| 1,669,482 | 5/1928 | Miller . | |
| 1,868,286 | 7/1932 | Grieve . | |
| 1,916,792 | 7/1933 | Hadden . | |
| 1,946,208 | 2/1934 | Hampton . | |
| 2,041,676 | 5/1936 | Gallagher . | |
| 2,087,685 | 7/1937 | Hackney . | |
| 2,201,638 | 5/1940 | Theibault, Sr. . | |
| 2,460,435 | 2/1949 | Schaffer . | |
| 2,960,338 | 11/1960 | Havey et al. . | |
| 3,212,783 | 10/1965 | Bradley et al. . | |
| 3,761,095 | 9/1973 | Thompson . | |
| 3,815,921 | 6/1974 | Turner | 273/167 A |
| 3,976,299 | 8/1976 | Lawrence et al. . | |
| 4,214,754 | 7/1980 | Zebelean . | |
| 4,313,607 | 2/1982 | Thompson . | |
| 4,322,083 | 3/1982 | Imai . | |
| 4,332,388 | 6/1982 | Crow . | |
| 4,432,549 | 2/1984 | Zebelean . | |
| 4,511,145 | 4/1985 | Schmidt . | |
| 4,681,321 | 7/1987 | Chen et al. . | |
| 4,809,977 | 3/1989 | Doran et al. . | |
| 4,854,581 | 8/1989 | Long | 273/169 |
| 4,872,685 | 10/1989 | Sun . | |
| 4,930,781 | 6/1990 | Allen . | |
| 5,042,806 | 8/1991 | Helmstetter . | |
| 5,067,715 | 11/1991 | Schmidt et al. . | |
| 5,180,166 | 1/1993 | Schmidt et al. . | |
| 5,240,252 | 8/1993 | Schmidt et al. . | |
| 5,271,620 | 12/1993 | Moriguchi et al. . | |

FOREIGN PATENT DOCUMENTS

| | | |
|---|---|---|
| 1476889 | 5/1975 | United Kingdom . |
| 2100993 | 1/1983 | United Kingdom . |
| 2225725 | 6/1990 | United Kingdom . |
| 2230459 | 10/1990 | United Kingdom . |

*Primary Examiner*—V. Miller
*Assistant Examiner*—Steven B. Wong
*Attorney, Agent, or Firm*—William W. Haefliger

[57] ABSTRACT

A set of golf club heads, each head comprising a shell having toe and heel portions, and a front wall defining a ball striking face, and top or bottom walls, the ball striking faces of the heads having varying angularities with respect to vertical, the bottom wall of each head having a medial ridge, and forming two dished, similar shallow recesses, one recess between the ridge and heel portion and the other recess between the ridge and toe portion, the recesses located rearwardly of said front wall, one recess having an arcuate peripheral edge generally convex toward the heel portion and the other recess having an arcuate peripheral edge generally convex toward the toe portion.

45 Claims, 15 Drawing Sheets

FIG. 15.
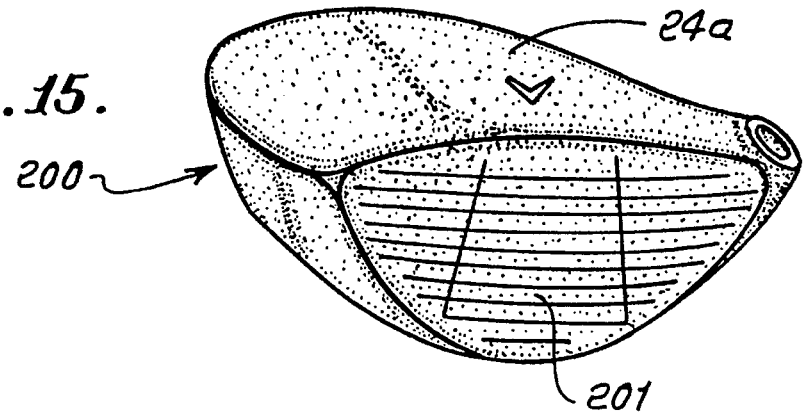
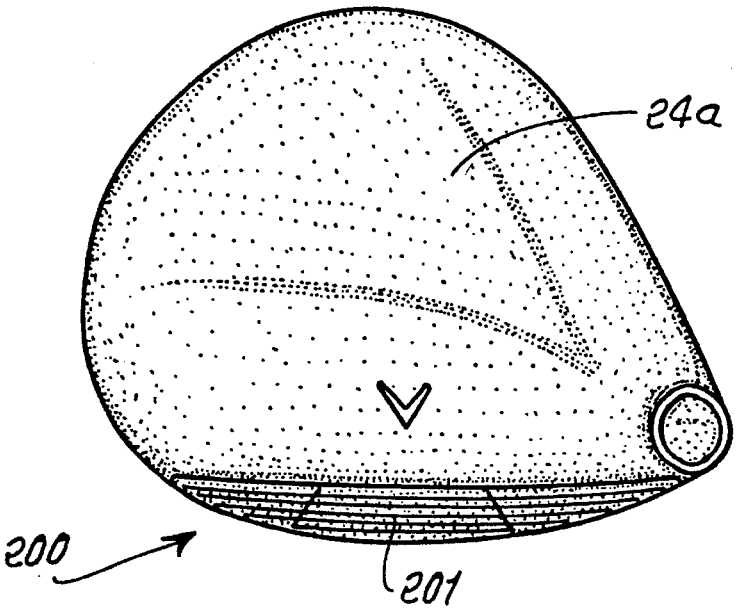
FIG. 16.
FIG. 17.
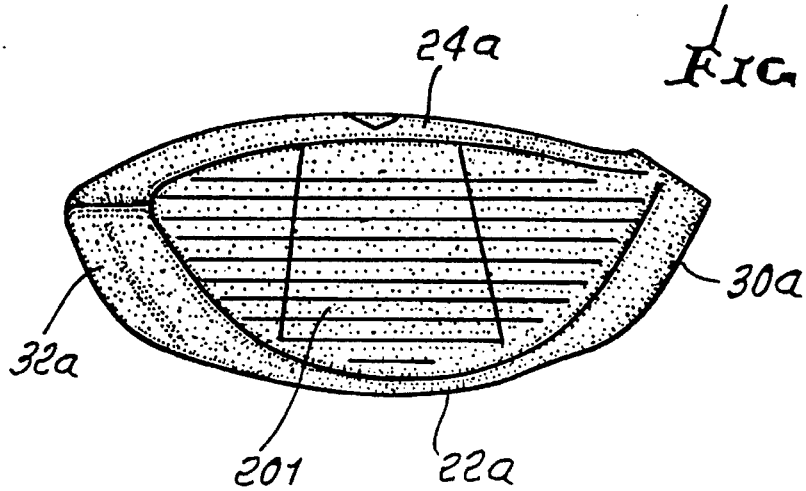

FIG. 46.
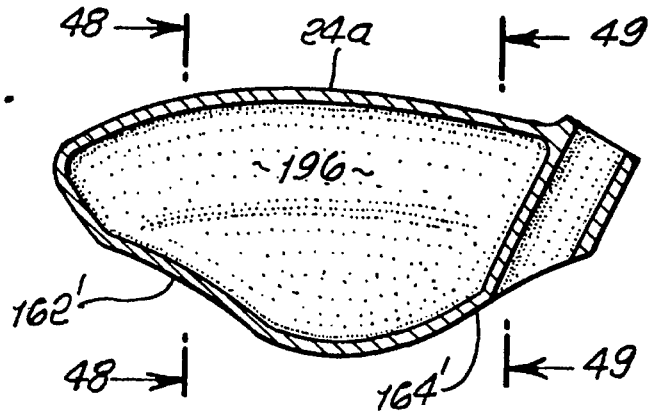
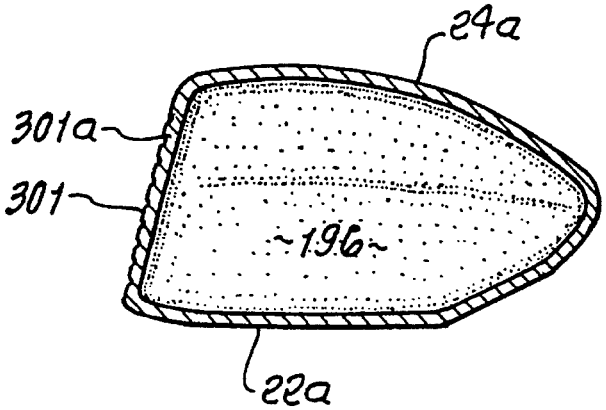
FIG. 47.
FIG. 48.
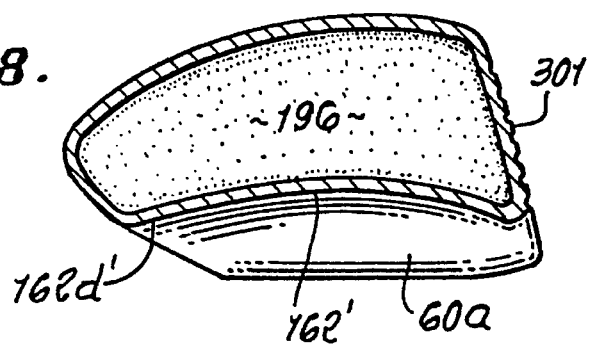
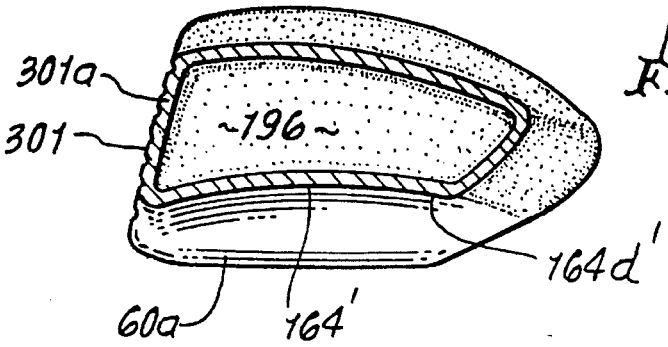
FIG. 49.

HOLLOW, METALLIC GOLF CLUB HEAD WITH RELIEVED SOLE AND DENDRITIC STRUCTURES

This application is a continuation-in-part of Ser. No. 08/029,553 filed Mar. 11, 1993 now U.S. Pat. No. 5,301,945 issued Apr. 12, 1994 which is a continuation of Ser. No. 07/819,379 filed Jan. 15, 1992, now U.S. Pat. No. 5,240,252 issued Aug. 31, 1993, which is a continuation-in-part of Ser. No. 07/791,322 filed Nov. 14, 1991, now U.S. Pat. No. 5,180,166 issued Jan. 19, 1993, which is a continuation of Ser. No. 07/595,963 filed Oct. 16, 1990, now U.S. Pat. No. 5,067,715 issued Nov. 26, 1991.

BACKGROUND OF THE INVENTION

This invention relates generally to increasing the size of metallic, hollow golf club heads (woods) without increasing head weight. More particularly, it concerns the distribution of ball impact waves from the head front wall in such manner as to resist deflection of that front wall and to absorb such shock waves on top, bottom, and rear walls.

Large, very thin-walled, metal golf club heads present the problems of cracking and buckling of metal walls, and excessive front wall deflection, during ball impact. There is need to alter the manner in which shock or stress waves are distributed within metal wood walls, as by providing a mechanism which guides, interrupts, spreads, or otherwise alters the shock waves which emanate from the face at impact, but while maintaining optimum wall thicknesses.

There is also need to strengthen the thinned bottom walls, or sole plates, of such golf club heads, as well as to reduce drag forces at such bottom walls during stroking.

SUMMARY OF THE INVENTION

It is a major object of the invention to provide structure overcoming the above problems and disadvantages. Basically, the improved head of the invention is characterized by a ball striking front wall, a bottom wall, and spaced toe and heel walls, the bottom wall characterized as having two shallow recesses, one recess closer to the heel portion, and the other recess closer to the toe portion, the recesses being everywhere spaced rearwardly from the front wall, the one recess having an arcuate peripheral edge generally convex toward the toe portion.

Such recesses typically have downward facing surfaces with shallow upwardly dished configuration. The downward facing surfaces are concave in front-to-rear directions; and the downward facing surfaces are also concave in directions between the heel and toe.

Another object is to provide a bottom wall structure that will aid in "digging out" a golf ball having a bad lie.

Another object is to provide such a head wherein the bottom wall has a locally flattened, rearwardly divergent surface that extends at a rearwardly and upwardly extending angle, beyond rearward extent of a medial ridge, and between rearward extents of the recesses. That flattened surface may merge with peripheries of the dished recesses, as will appear.

A further object is to provide the bottom wall to be in part defined by a sole plate having a peripheral edge rigidly connected to the bounding edge of an opening defined by the bottom wall, rearwardly of the front wall, whereby the sole plate closes the opening, the medial ridge and recesses also being in part defined by the sole plate. In this regard, the sole plate typically defines major extents of the shallow recesses.

A head body shell may also define a rigidizing bottom wall corner plate section integral with shaft supporting tube structure, the sole plate also connected to that corner plate section, the corner plate section also forming a portion of the one shallow recess closest tot the head heel portion.

Yet another object is to provide a first group of narrow, metallic, shock wave distributing dendrites extending from the front wall generally rearwardly adjacent the underside of the shell top wall and integral therewith, the dendrites projecting toward the two shallow recesses, the bottom wall defining those recesses being upwardly concave toward the dendrites.

A second group of dendrites may also be provided to be integral with the top wall and spaced apart to extend generally rearwardly to merge rearwardly and downwardly with a rear wall defined by the shell to transfer rearward loading to that wall as the dendrites pick up rearward loading from the top wall in response to front wall impact with a golf ball, the second group of dendrites also projecting toward the two shallow recesses.

The dendrites are such as to transfer, spread, dampen, and distribute impact-produced shock so as to reduce shock wave concentration otherwise imposed on the junction between the front wall and top wall. Shock waves are produced by high speed impact of the club head with the golf ball which leaves the head only ½ millisecond after impact, for a driver with head traveling at 100 miles per hour. The dished walls of the plate also strengthen the structure for shock load transmission.

It is another object to provide hosel structure that extends downwardly into the head interior and forms a shaft-receiving opening. This strengthens the connection of the front wall to the dished sole plate and heel, and reduces hosel weight, so that such weight can be utilized to form the dendrites, as referred to. In this regard, the invention enables the provision of a larger overall volume head, as compared with the head of the same weight, but lacking the dendritic structure, as referred to. As will be seen, the use of such structure enables thinning of the hollow head top, toe, back, and heel walls.

Another object is to provide a head bottom wall which controls engaged turf relative movement (during a golf swing) so as to create upward force or force acting on the head in a manner resulting in reduced drag as the head is swung.

Another object is to provide a set of golf club heads, each head comprising a shell having toe and heel portions, and a front wall defining a ball striking face, and top or bottom walls, the ball striking faces of the heads having varying angularities with respect to vertical, the bottom wall of each head having a medial ridge, and forming two dished, similar shallow recesses, one recess between the ridge and heel portion and the other recess between the ridge and toe portion, said recesses located rearwardly of said front wall, one recess having an arcuate peripheral edge portion generally convex toward said heel portion and the other recess having an arcuate peripheral edge portion generally convex toward said toe portion. Each recess of each head may have a downwardly facing surface further characterized in that, for each said head, i) a vertical plane bisecting the recess in a toe to heel direction intersects the recess surface along a downwardly concave line, and ii) a vertical plane bisecting the recess in a front to rear direction relative to the head intersects the recess surface along a downwardly concave line.

Also, the two concave recesses of each head typically have similar configuration with respect to a vertical plane that bisects said ridge in a front to rear direction relative to the head. Further each recess of each such head may have a downwardly facing surface further characterized in that, for each head i) the rearwardmost extent of said downwardly facing surface is inclined forwardly and upwardly relative to the head forward swing path as the head bottom wall engages the turf, ii) whereby lift force is created in response to engagement of said rearwardmost extent of said surface with the turf as the head is swung forwardly along said path, such lift force acting to urge the head bottom wall and the head in an upward direction.

Yet another object is to provide for each head, a bottom wall having a rearwardly divergent surface (which may be locally flattened) that extends at a rearwardly and upwardly extending angle, beyond rearward extent of said ridge, and between rearward extents of said recesses, for reducing drag as the head is swung forwardly in an arc, adjacent the turf. In this regard, guided engagement with the turf and upward force exertion are enhanced by a configuration wherein the rearwardly divergent surface and the two recesses have edges which, when viewed from the rear of the head, are upwardly convex. Also, for each head, there may be provided a substantially continuous, hollow, metallic tube extending within the shell of the heel portion and from proximate the shell top wall to proximate the shell bottom wall, that tube having a bore to receive a club shaft, the bore aligned with the one shallow recess.

A further object is to provide a set of heads, as referred to, which includes at least two or more of the following:

a) a metal wood having a front face inclined at approximately 9° from vertical, b) a metal wood having a front face inclined at approximately 11° from vertical, c) a metal 2 wood, d) a metal 4 wood, e) a metal 5 wood.

Yet another object of the invention is to provide a set of heads characterized by one of the following:

a) at least one head has a center of gravity located at approximately 42 to 50% of the head height as measured upwardly from the lowermost head surface to the uppermost head surface, viewed from the front of the head, b) each of at least two of the heads has a center of gravity located at approximately 42 to 50% of the head height as measured upwardly from the lowermost head surface to the uppermost head surface, viewed from the front of the head.

A still further object is to provide an improved golf club had, and method of forming same, to incorporate components in construction, mode of operation and results, when used, as referred to.

These and other objects and advantages of the invention, as well as the details of an illustrative embodiment, will be more fully understood from the following specification and drawings, in which:

DRAWING DESCRIPTION

FIG. 15 is a perspective view showing the top, front and toe regions of a golf club driver head having 9° front face inclination;

FIG. 16 is a top plan view of the FIG. 15 head;

FIG. 17 is a front face elevation view of the FIG. 15 head;

FIG. 46 is a section taken in elevation on lines 46—46 of FIG. 30;

FIG. 47 is a section taken in elevation on lines 47—47 of FIG. 30;

FIG. 48 is a section taken in elevation on lines 48—48 of FIG. 46; and FIG. 49 is a section taken in elevation on lines 49—49 of FIG. 46.

DETAILED DESCRIPTION

Figure 1:
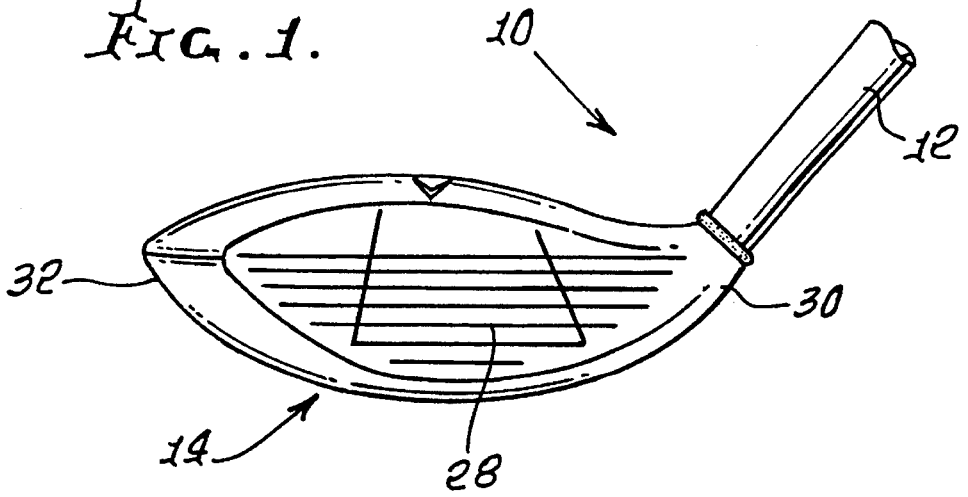
FIG. 1 is a front elevational view of a golf club head incorporating the invention.

Referring now to the drawings, a golf club 10, in accordance with a preferred embodiment of the present invention, is shown. The club 10 includes a shaft 12 (only the lower portion of which is shown), which is attached to a head 14. The head 14 is in the configuration of a "wood" club, although it is made of metal. As shown in FIGS. 5–8, the head comprises a hollow metal shell 16, which is filled with a plastic foam filling 18, preferably polyurethane.

The shell 16 is preferably made of stainless steel, and it may be fabricated by the "lost wax" casting method that is well-known in the art. The shell 16 is formed in two pieces: a main portion 20 and a sole plate 22 that is peripherally welded to the main portion 20, and as will be referred to.

Figure 2:
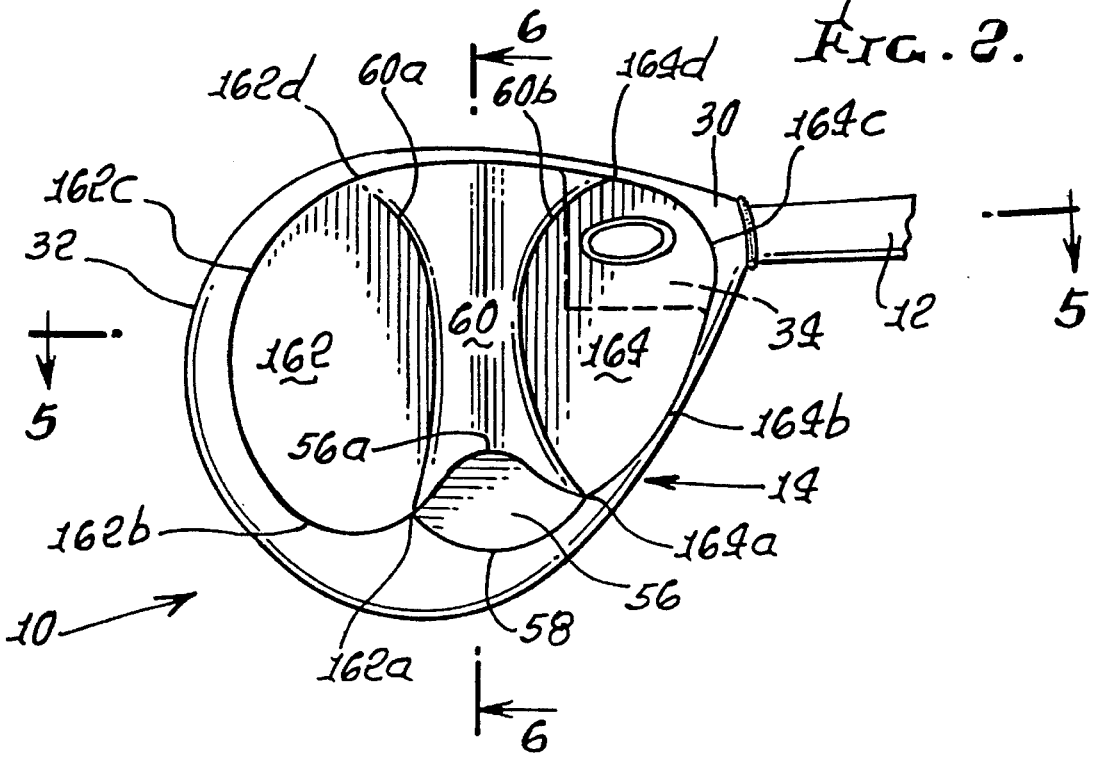
FIG. 2 is a plan view of the bottom of the FIG. 1 head.

The main shell portion 20 has a top surface 24, a rear surface 26, and a ball-striking surface or face 28 opposite the rear surface 26. The face 28 is angled with respect to the vertical with a specified "pitch" that is determined by the type of club and the amount of loft desired. The end portion of the head 14 proximate the shaft 12 is commonly termed the "heel" 30, while the end portion opposite the heel 30 is termed the "toe" 32. As shown in FIG. 2, the face 28 is typically curved from the heel 30 to the toe 32. The main shell portion 20 has a bottom corner portion 34 (shown in FIG. 10) that is cast integrally with the front wall **28*a* and with the heel wall 30*a*, and flush with the sole plate 22, and that forms a bottom surface or sole in combination with the sole plate 22** when the two shell portions are welded together.

Figure 5:
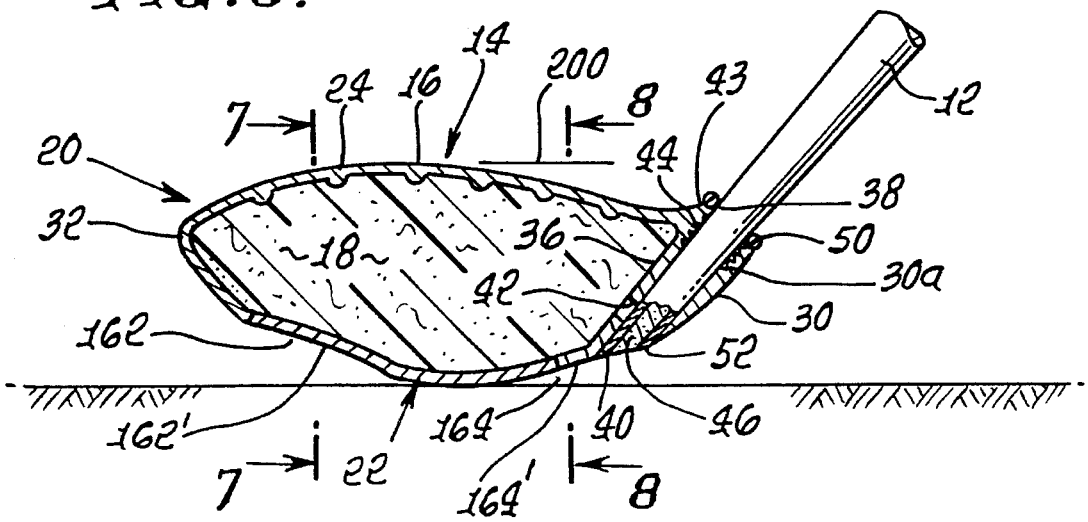
FIG. 5 is an elevation taken in section on lines 5—5 of FIG. 2.
Figure 6:
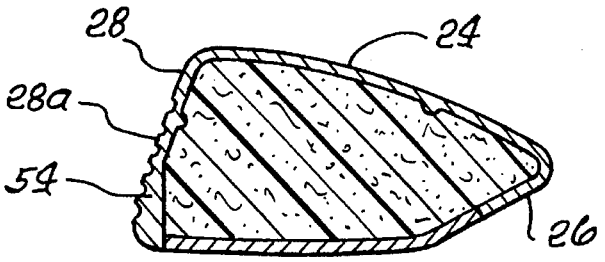
FIG. 6 is an elevation taken in section on lines 6—6 of FIG. 2.
Figure 7:
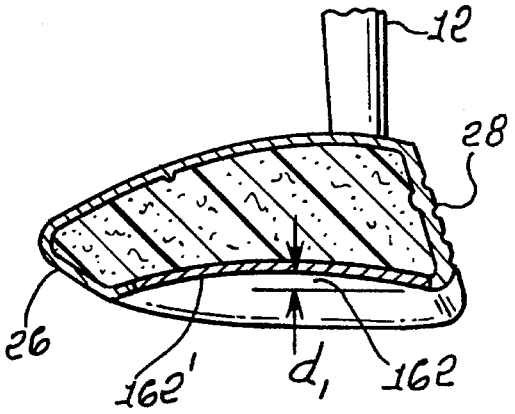
FIG. 7 is an elevation taken in section on lines 7—7 of FIG. 5.
Figure 8:
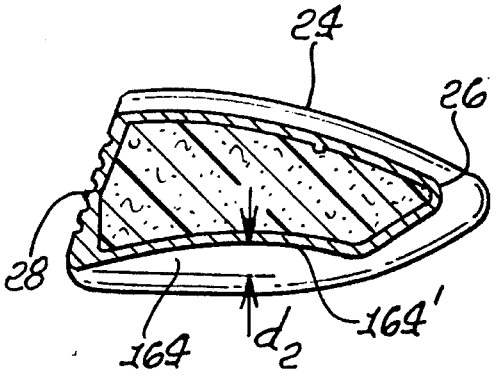
FIG. 8 is an elevation taken in section on lines 7—7 of FIG. 5.
Figure 9:
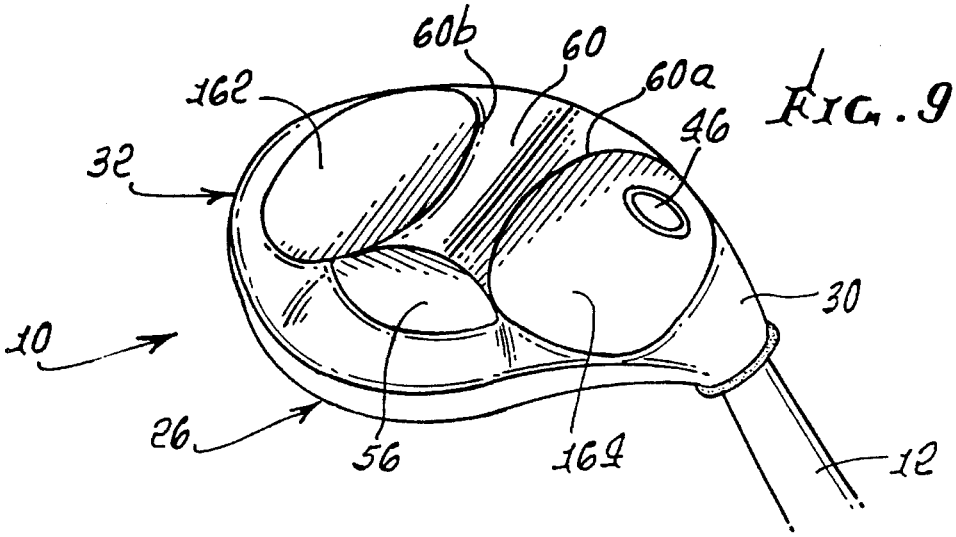
FIG. 9 is a perspective view showing the bottom, rear, and heel end of the FIG. 1 club head.

Referring now to FIG. 5, the heel wall **30*a* of the shell 16 is provided with a substantially continuous hollow tube 36 that extends from an upper opening 38 in the top surface 24 to a lower opening 40 in the bottom surface or sole through the bottom corner portion 34 of the main shell portion 20. The tube 36 is of substantially uniform internal diameter, and its side wall is interrupted by an internal orifice 42 that opens into the interior of the shell. The orifice 42 provides an entrance for the introduction of the foam material 18** into the shell interior during the manufacturing process.

Figure 3:
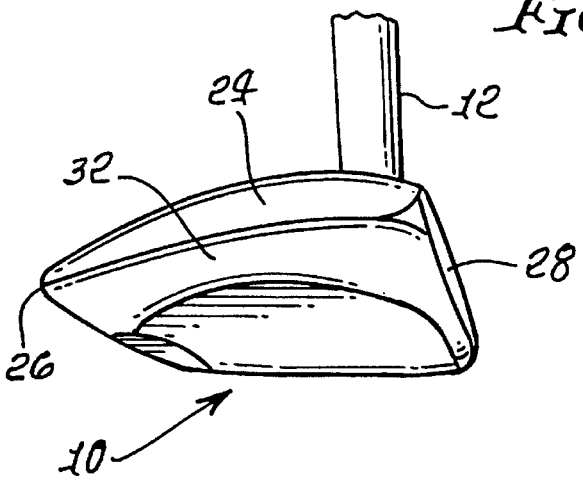
FIG. 3 is an elevational view of the toe end of the FIG. 1 head.

The tube 36 is dimensioned to receive the lower part of the shaft 12 with a snug fit. The upper opening 38 is provided with a radiused lip 43, as shown in FIG. 3, to minimize the possibility of stress fractures in the shaft due to impact against the edge of the opening. A portion of the interior wall of the tube 36, extending downwardly from the upper opening 38, may be provided with striations, preferably in the form of internal threads, or a series of concentric steps 44, to provide a "glue lock" for better bonding of the shaft in the tube.

In the preferred embodiment of the invention, the lip 43 is at the end of a slight rise at the heel end of the head, the height of the rise being less than, or approximately equal to, the height of a horizontal plane 200 defined by the highest point of the club head top surface 24.

The shaft 12 is a hollow tube made of any suitable material. Steel is the most common material, but titanium and graphite-boron may also be used. If the shaft is of steel, the exterior of the shaft may be chrome-plated to minimize corrosion. The lower part of the shaft may be fitted with a plug 46 to prevent the entry of moisture into the interior of the shaft. The plug 46 may be of any suitable resilient material, such as Nylon, epoxy, polyurethane, or Delrin. The plug 46 may be retained in the shaft by an annular crimp in the shaft wall. The crimp also serves as a glue lock. A locator ring 50, preferably of glass fiber-reinforced nylon, is adhesively bonded to the shaft at a distance above the bottom end 52 of the shaft approximately equal to the length of the tube 36.

Figure 4:
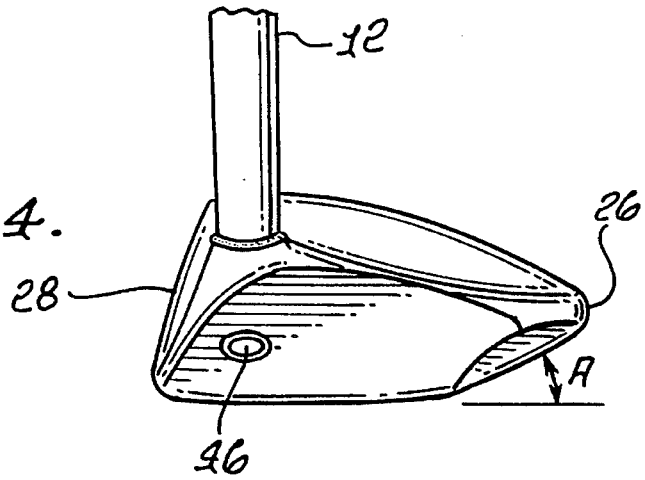
FIG. 4 is an elevational view of the heel end of the FIG. 1 head.

The shaft 12 may be attached to the head 14 by a suitable epoxy adhesive, the steps or threads 44 in the tube 36 and the crimp 48 in the shaft providing "glue locks", as mentioned above, for better adhesive bonding. (Any plating on the lower part of the shaft is first buffed off.) During assembly, the lower part of the shaft is inserted into the tube 36 until the locator ring 50 abuts against the radiused lip 43 at the upper tube opening 38. The bottom end 52 of the shaft 12 then extends slightly beyond the lower tube opening 40. This bottom end 52 is then cut and ground so as to be flush with the sole of the head, as shown in FIGS. 4 and 5.

The structure described above allows the shaft to be attached to the head without a neck or hosel. As a result, substantially all of the mass of the head is "effective mass" that contributes to the transfer of energy from the player to the ball, with little or no "deadweight" to reduce the attainable club head velocity. By increasing the effective mass of the club head without reducing the attainable velocity, there is a more effective transfer of energy to the ball from the player, yielding increased shot distance without an increase in effort on the part of the player.

Moreover, without an external hosel, the lower part of the shaft may extend all the way through the head, with the bottom end 52 of the shaft terminating flush with the sole. Thus, by eliminating the external hosel, the shaft both enters, and may exit the head, within the area defined between the top and bottom of the face of the club head, which area is sometimes called the "ball control zone". By bringing the lower end of the shaft within the control zone, and extending the shaft deeply into the head shell, for example through to the sole of the club head, the tactile sense of the location of the club face, or "head feel", is maximized, yielding increased control of the shot, greater ability of the skilled player to "work" the ball, and a more solid feel of impact with the ball regardless of where on the face the ball is struck. The increase in effective mass of the club head, plus the rigid support for the lower end of the shaft, provided by the internal tube 36 in which the lower end of the shaft is received, further contribute to this improvement in "head feel".

Furthermore, a number of advantages in the manufacturing process can be achieved by eliminating the hosel. For example, the mass that would have been taken up by the hosel can be redistributed to a part of the club head where it can contribute to the effective mass of the head without increasing the total head mass. Optimally, this mass can be added by increasing the overall size of the club head.

Still another advantage of eliminating the hosel is that there is a more even cooling of the club head in the mold.

Where there is an upward hosel, by comparison, the hosel and the rest of the club head shell may cool at unequal rates, thereby resulting in a slight warping that can produce a lack of uniformity in loft, lie, and face angle from club head to club head.

A golf club, in accordance with a preferred embodiment of the invention, includes the sole configuration shown in the drawings.

As shown in the drawings, the bottom wall is characterized as forming a medial ridge 60, and as forming two shallow recesses, one recess between the ridge and the heel portion, and the other recess between the ridge and the toe portion, the recesses everywhere spaced rearwardly from the front wall, the one recess having an arcuate peripheral edge generally convex toward the heel portion, and the other recess having an arcuate peripheral edge generally convex toward the toe portion. Examples of such shallow, upwardly dished recesses are seen at 162 between the ridge 60 and the toe 32, and at 164 between the ridge and heel 30.

Recess 162 curved periphery, which extends in a looping edge path, indicated at 162*a*, 162*b*, 162*c*, and 162*d*, and recess 164 also extends in a looping edge path indicated at 164*a*, 164*b*, 164*c*, and 164*d*, both paths located on the bottom wall, as shown. The maximum depth of each recess below a plane containing its peripheral looping edge path is less than ¼ inch, and preferably between 1/16 inch and 3/16 inch. See depths $d_1$ and $d_2$ in FIGS. 7 and 8. These depths are sufficient to avoid direct frictional contact of recess dished inner surfaces 162' and 164' with the ground during a club stroke, ground contact, if any, being confined to the lowermost extent of the central ridge 60. Also, the upward bi-directional concavity of the bottom wall extents 162' and 164' forming the recesses adds to bottom wall strength, and stiffness, for transmitting shock loading transmitted to and from the front wall 28 during ball stroking. The bottom wall thickness may then be minimized and metal "redistributed" to enable provision of a larger sized head.

Note also the provision of a bottom wall rearwardly divergent surface that extends at a rearwardly and upwardly extending angle, beyond rearward extent of the ridge, and between rearward extents of the recesses.

Specifically, there is a trailing surface 56, which is a relieved, upwardly angled, somewhat flattened portion extending upwardly from a curved edge 56*a* and between that edge and the center of the sole and a trailing edge 58 at the juncture between the rear surface 26 of the club head and the sole plate 22. The lowermost curved part 56*a* of the surface 56 is contiguous with the rearward end of ridge 60 that extends forward toward and diverges at 60*a* and 60*b* to merge laterally with the bottom U-shaped edge of the face 28 of the club head.

The trailing surface 56 preferably extends at an angle A of approximately 18° with respect to the horizontal. The angle A may be varied by plus or minus up to 5 degrees, depending on the type of club and the preference of the player. The trailing surface 56 minimizes the club head's closing, or "hooding", when the ball is hit "fat", while reducing the overall aerodynamic drag of the club head to maximize its attainable velocity during the swing.

Further, in regard to the described combination of bottom wall contours, the ridge downward curvature rearwardly of the front face, and between the dished recesses 162 and 164 enables the sole to penetrate the turf, resisting and repelling the turf against the dished out zones 162 and 164 to limit penetration in proportion to or accordance with the unique shape of the sole as a unit, in a unique way, the front face having a downward U-shape forward of the recesses and ridge, as is clear from FIGS. 1 and 2. Note the ridge diverging forwardly toward the U-shaped front face.

Accordingly, a golf ball having a "bad lie" can be approached in a confident way, to "dig" the ball out by means of a club stroke characterized in that the club head sole planes over the turf, considering the turf as fluid. For a golf ball having a more conventional lie, no "digging out" is required, and an improved downward sole shape "footprint" is produced on the turf, as will be referred to.

Figure 10:
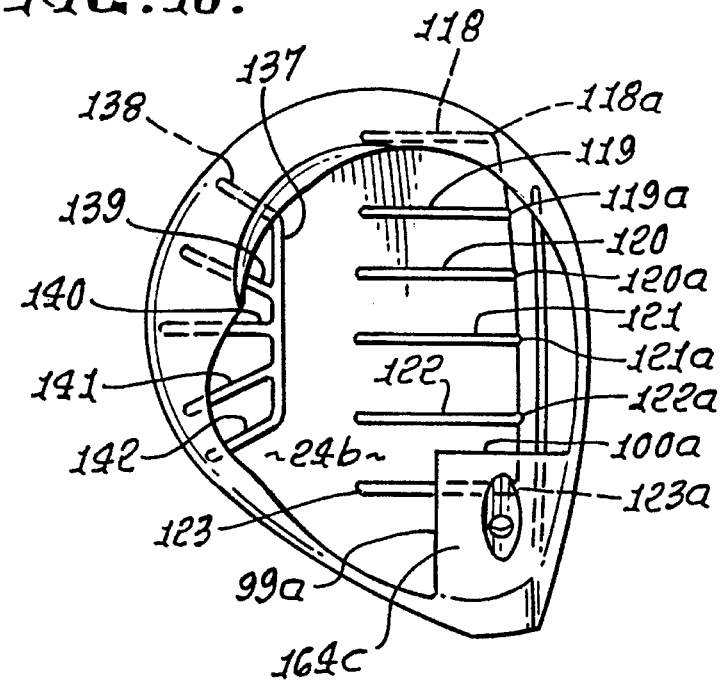
FIG. 10 is a plan view showing the bottom of the FIG. 1 head, but prior to attachment of a sole plate.
Figure 11:
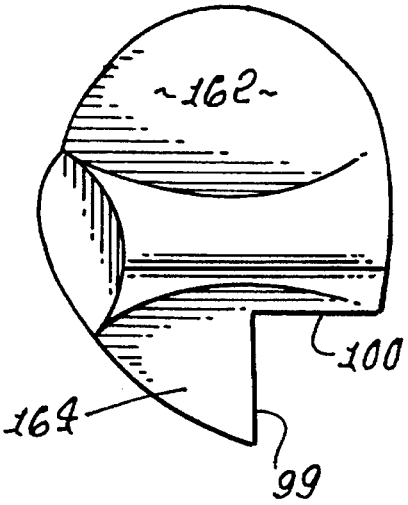
FIG. 11 is a plan view of the sole plate that fits into the bottom opening shown in FIG. 10.

Referring to FIGS. 5, 10, and 11, hosel tube 36 extends downwardly into the hollow interior of the heel portion of the head, and is adapted to receive a shaft 12. Thus, the weight of the hosel is concentrated more directly behind, or close to, the rear side of front wall 28, near the heel, to contribute to the ball-striking mass of the front wall. Also, the hosel cylindrical wall reinforces the junction of the front wall, bottom wall, and heel wall. See also rigidizing hosel webbing or filleting 34 which forms the corner plate section of the bottom wall 22. Corner section also forms a portion of the dished portion of the bottom wall recess 164. When the sole plate is attached to the shell, a weld may be formed along edges 99 and 99*a*, and 100 and 100*a*. See FIGS. 10 and 11.

In accordance with another important aspect of the invention, a first group or set of narrow, metallic dendrites is provided to extend from the front wall 28 generally rearwardly adjacent the underside 24*b* of the top and upper wall 24*a*, and integral therewith. See, in the example, dendrites 118–123 spaced apart in a transverse direction indicated by arrows 120, the dendrites having forward ends 118*a*–123*a* merging into the front wall at its junctions with the top wall. Note the possible widening of the dendrites as they merge with front wall 28. This serves the purpose of distributing impact-produced shock or stress waves from the front wall to the top wall, especially when a ball is hit high on the front wall or face. This in turn serves to prevent cracking and buckling of the thin metal top wall 24. Note that the dendrites are spaced apart, i.e., branch, at intervals of about ½ to ¾ inch; and that the rearward ends of the dendrites are transversely spaced apart.

Figure 12:
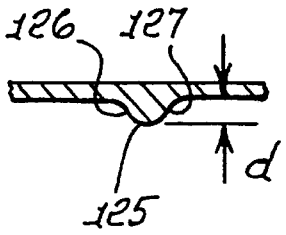
FIG. 12 is a fragmentary section showing dendrite structure.

The vertical dimension "$d_3$" of the dendrites lies within the range 0.050 to 0.070 inch; and the dendrites are generally convex at 125 toward the interior of the head, along their lengths, and have concave opposite sides at 126 and 127 (see FIG. 12). In this regard, and as referred to above, the thickness of the front wall is typically substantially greater than the thickness of the other walls, to strengthen it and prevent cracking under high impact loads. Typical wall approximate thicknesses are: front wall 0.120 inches (maximum), sole plate 0.050 inches (maximum), excluding possible local thickening projecting from front face intersection with the sole plate, and top wall 0.030 inches. The dimensions are less than standard thicknesses, allowing for a larger head and a larger moment of inertia for a given total weight. This in turn allows a greater "forgiveness effect" as regards off-center ball strikes.

Figure 13:
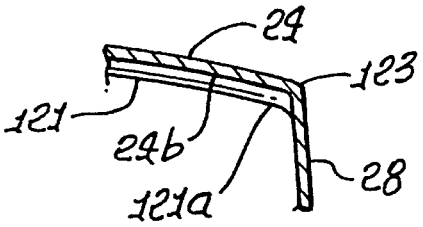
FIG. 13 is a fragmentary section showing dendrites extending rearwardly from the head front wall.

Further, the conformation of the dendrites 118–123 (see FIG. 13) along their lengths, to head interior wall shape, contributes to shock wave distribution across the upper wall 14. Note that wall 14 may be upwardly crowned, i.e., upwardly shallowly convex.

Also provided is a second set or group of narrow, metallic dendrites extending generally rearwardly adjacent the underside of the top wall and integral therewith, the second set also including a transversely extending dendrite intersecting the generally rearwardly extending dendrites of the second set. The dendrites of the second set are located further from the head front wall than the first set of dendrites, the rearwardly extending dendrites of the second set being spaced apart, or branching, in transverse direction, the vertical dimensions of the second set dendrites also being between 0.050 and 0.100 inches. See for example the five dendrites 138–142 that have fan configuration, radiating rearwardly from different points along the single dendrite 137 spaced rearwardly from dendrites 118–123.

Figure 14:
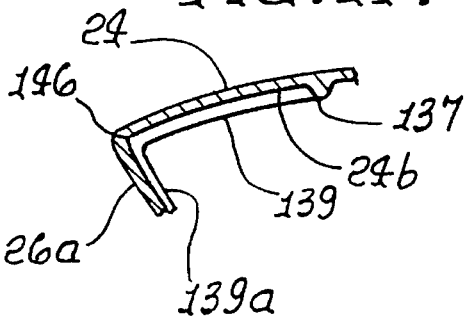
FIG. 14 is a fragmentary section showing dendrites extending rearwardly downwardly adjacent the top and rear walls of the head.
Figure 18:
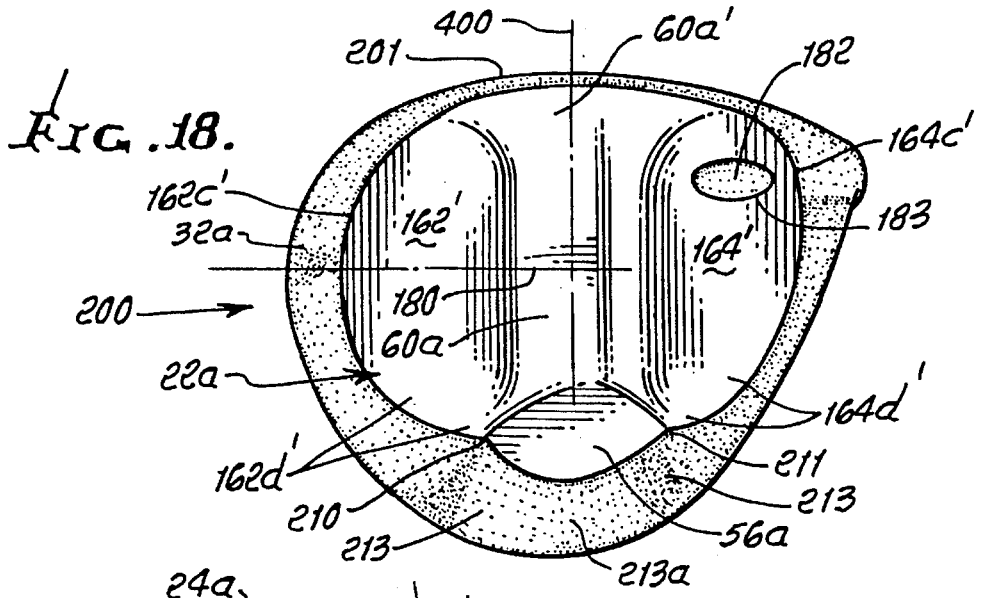
FIG. 18 is a bottom plan view of the FIG. 15 head.
Figure 19:
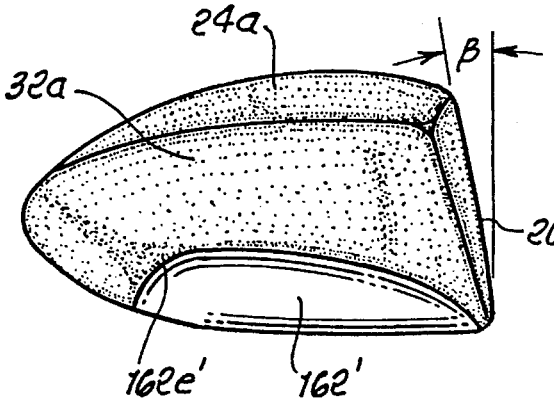
FIG. 19 is a toe end elevation view of the FIG. 15 head.
Figure 20:
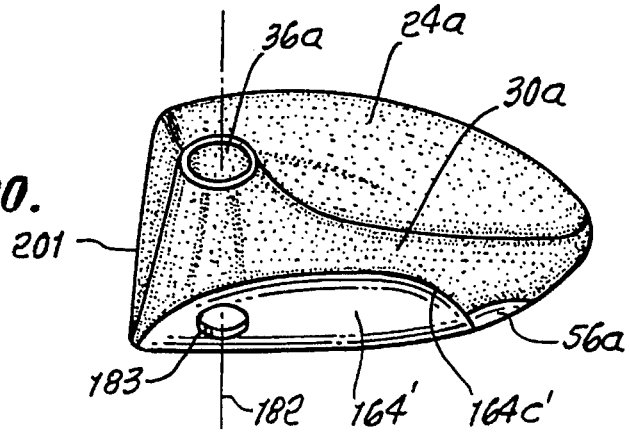
FIG. 20 is a heel end elevation view of the FIG. 15 head.
Figure 21:
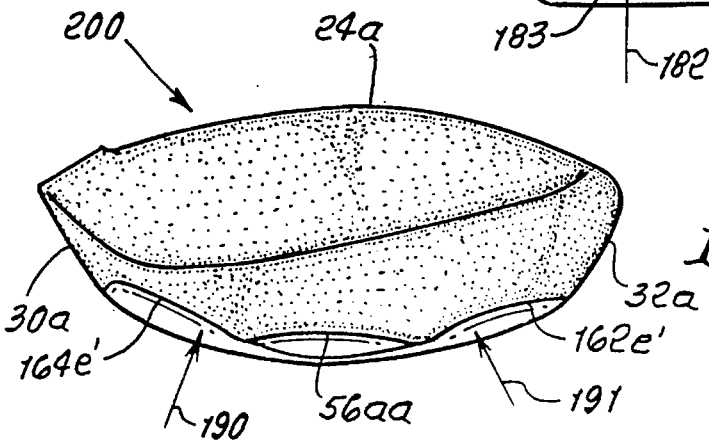
FIG. 21 is a rear elevation view of the FIG. 15 head.
Figure 22:
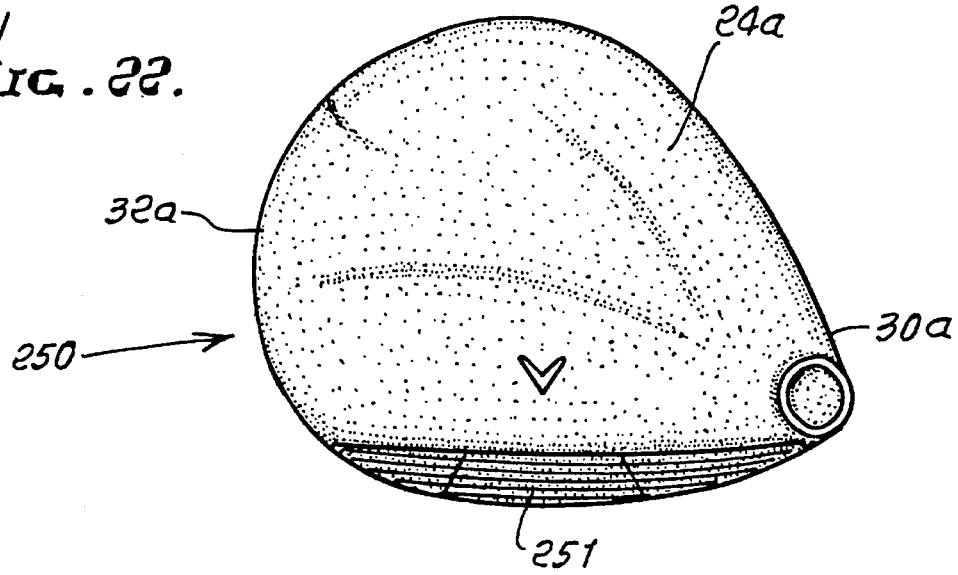
FIG. 22 is a top plan view of a golf club head, like the head of FIGS. 15–21, but having 11° front face inclination.
Figure 23:
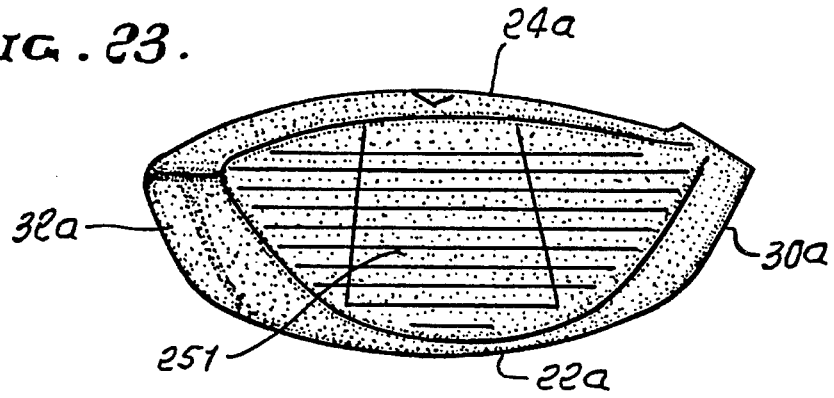
FIG. 23 is a front face elevational view of the FIG. 22 head.
Figure 24:
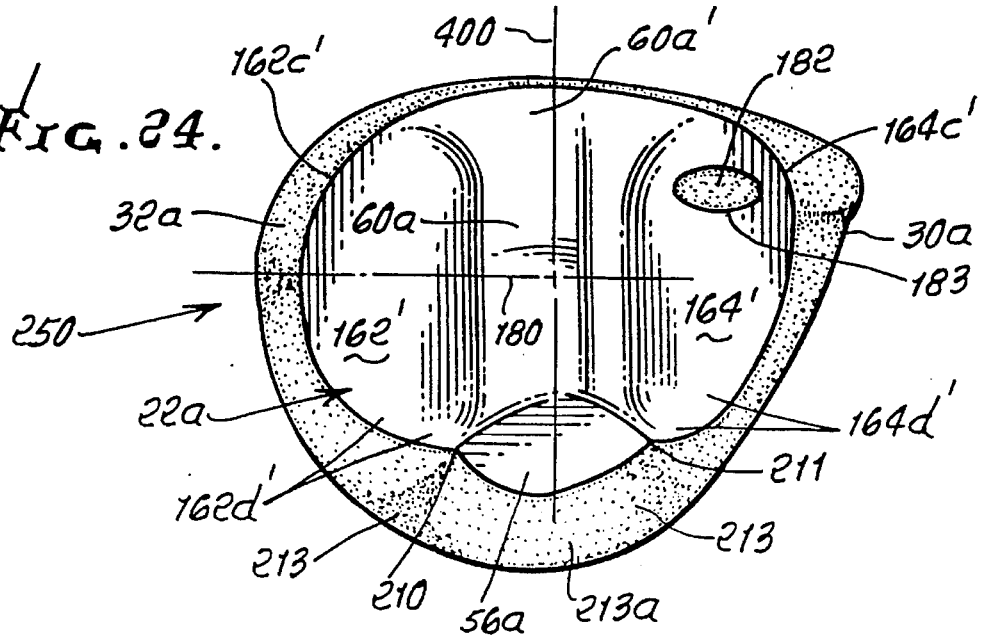
FIG. 24 is a bottom plan view of the FIG. 22 heads.
Figure 25:
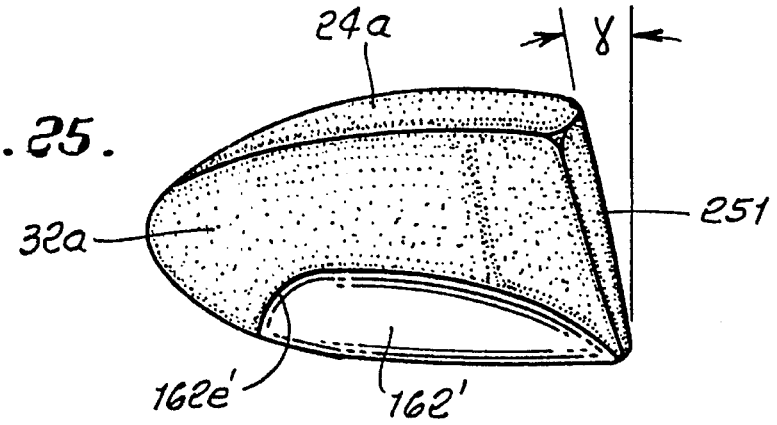
FIG. 25 is a toe end elevational view of the FIG. 22 head.
Figure 26:
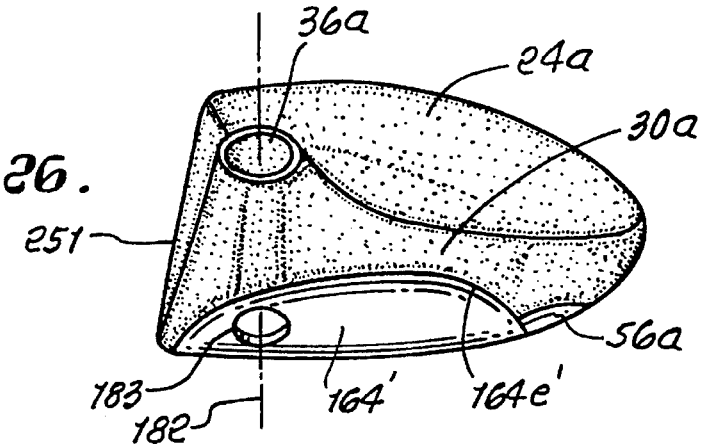
FIG. 26 is a heel end elevational view of the FIG. 22 head.
Figure 27:
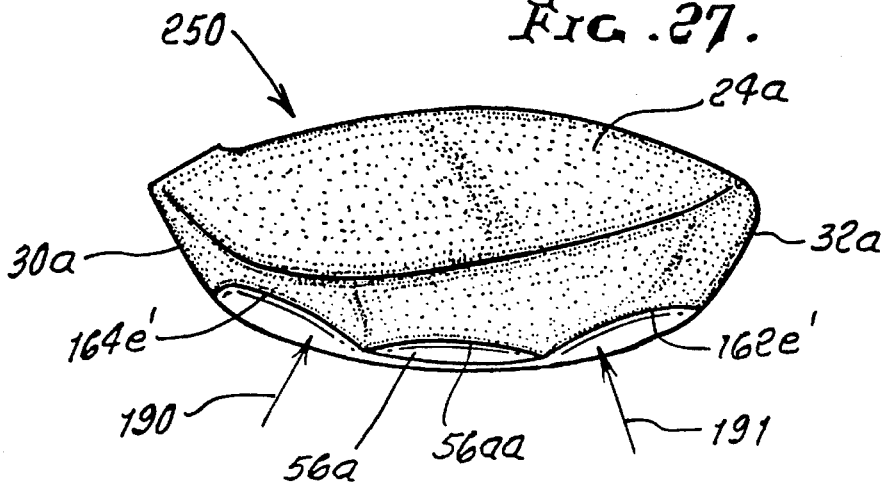
FIG. 27 is a rear elevational view of the FIG. 22 head.
Figure 28:
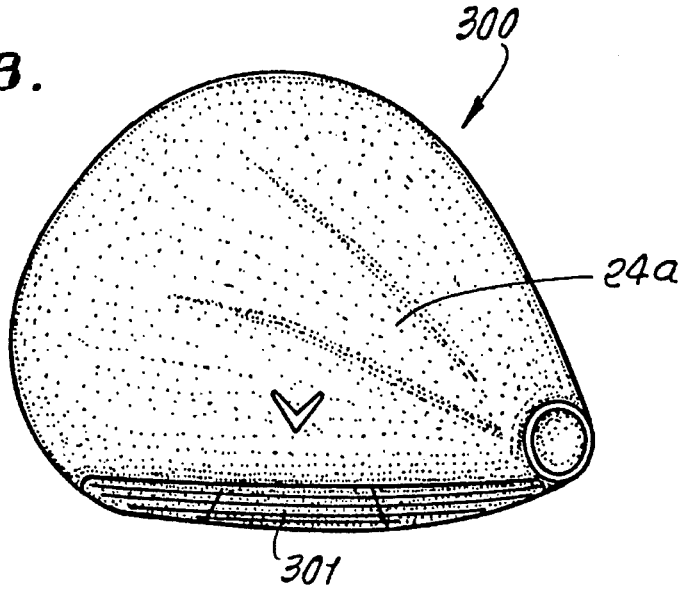
FIG. 28 is a top plan view of a golf club head, similar to the heads of FIGS. 15–27, but configured as a 2 wood.
Figure 29:
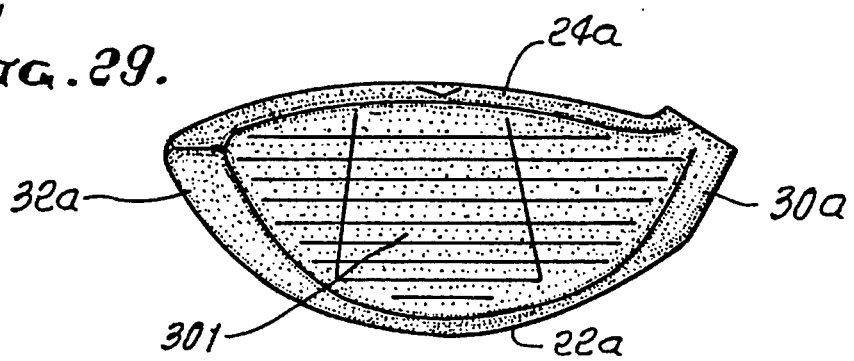
FIG. 29 is a front face elevation view of the FIG. 28 head.
Figure 30:
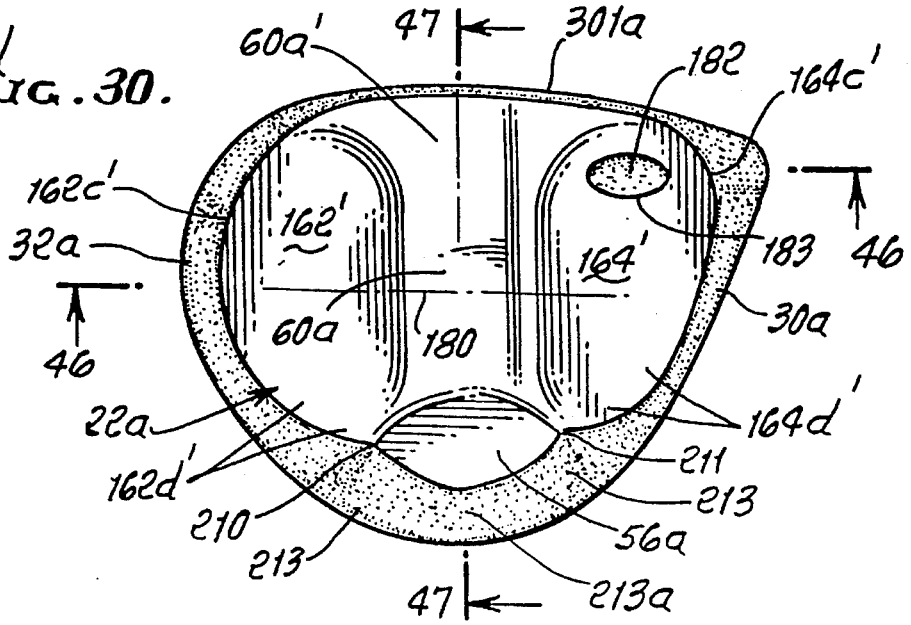
FIG. 30 is a bottom plan view of the FIG. 28 head.
Figure 31:
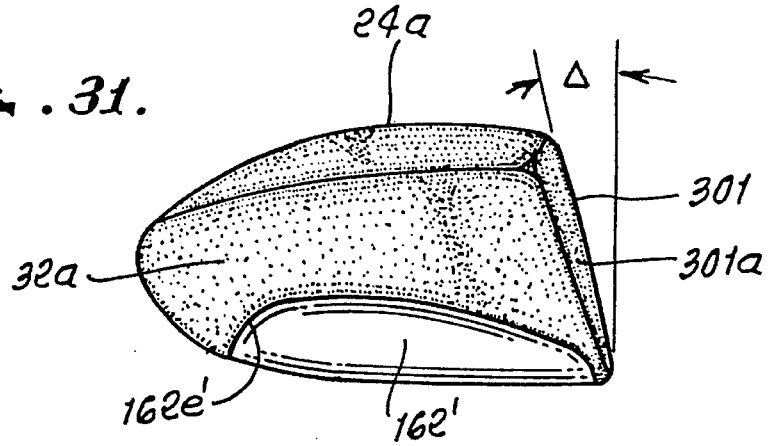
FIG. 31 is a toe end elevation view of the FIG. 28 head.
Figure 32:
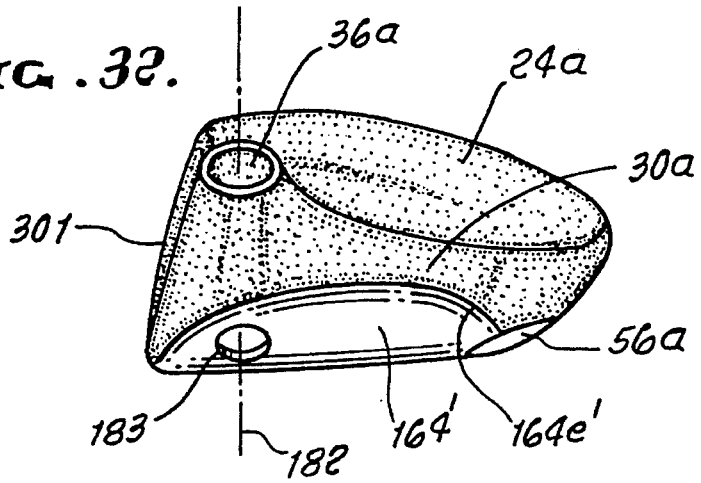
FIG. 32 is a heel end elevation view of the FIG. 28 head.

Dendrites 138–142 extend generally rearward to merge with the generally curved rear wall 26*a* of the head, to direct or transfer such rearward loading to that wall as the dendrites pick up loading from top wall 24*a*. See FIG. 14.

Dendrites 137–142 have generally the same configuration and dimensions as dendrites 118–123. Accordingly, they serve the same shock or stress wave transfer distributing functions to minimize cracking and buckling of the thinned top wall at its junction at 146 with the rear wall. Note also that dendrites 137–142 conform to top wall shape along their lengths. See FIG. 14. In addition, the rearward ends of the dendrites 137–142 turn downwardly adjacent the inner side of rear wall 26*a*, as seen at 139*a* in FIG. 14, for example.

The dendrites project generally toward the upwardly dished walls 162' and 164' so that both top and bottom walls are stiffened to transmit shock loading rearwardly, whether the ball strikes the front wall 28 relatively upwardly thereon, or at a lower portion thereof.

A further important aspect of the invention concerns the provision of a golf club head having a metal shell defining top, bottom, front, rear, toe, and heel walls, and wherein:

a) the bottom wall has upwardly dished wall extent, b) said upwardly dished wall extent defining downward facing surface means inclined forwardly and upwardly relative to the head swing path as the bottom wall engages the turf, so that the turf moving relatively rearwardly engages said inclined surface means for creating lift force acting to urge the bottom wall and the head in an upward direction, whereby drag is reduced and more kinetic energy is available for transfer to the ball.

Further, and as described, the bottom wall also has a downward facing medial ridge 60 which extends generally forwardly, said dished wall extent preferably including two dished extents 162 and 164, respectively, located at opposite sides of said ridge, each of said two dished extents defining a portion of said inclined surface means (at the rears of said dished extents 162 and 164) whereby upward lift forces are developed at opposite sides of said ridge, for torsionally balanced upward lift imparted to the head.

Finally, the turf controlling head bottom wall can be formed or cast integrally with the remainder of the head, if desired, i.e., it need not be separately formed and later welded to a rim defined by a separately cast head. Such forming may be by a casting or molding process employing metallic or non-metallic material.

The bottom wall and/or the rest of the head can be made of materials other than metal.

As used herein, the word "turf" shall be understood to mean grass, weeds, sand, mud, and other material engageable and displaceable by the bottom wall of the head.

Figure 37:
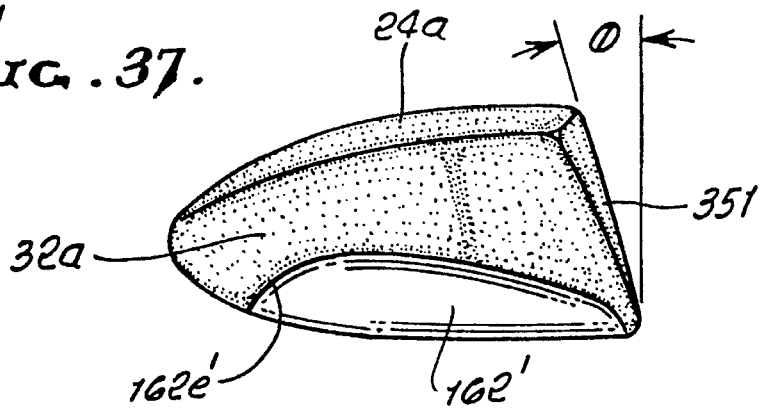
FIG. 37 is a toe end elevation view of the FIG. 34 head.
Figure 38:
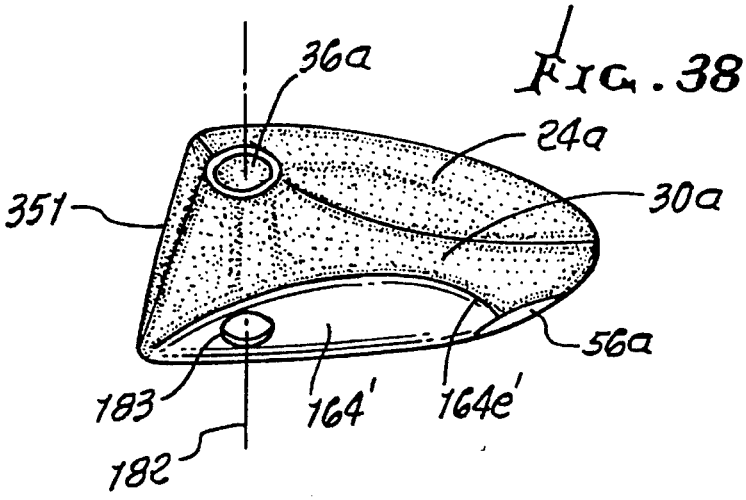
FIG. 38 is a heel end elevation view of the FIG. 34 head.
Figure 39:
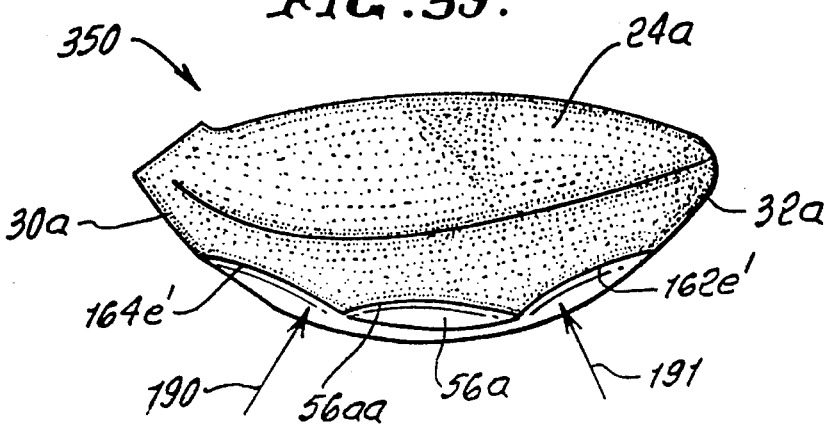
FIG. 39 is a rear elevation view of the FIG. 34 head.
Figure 40:
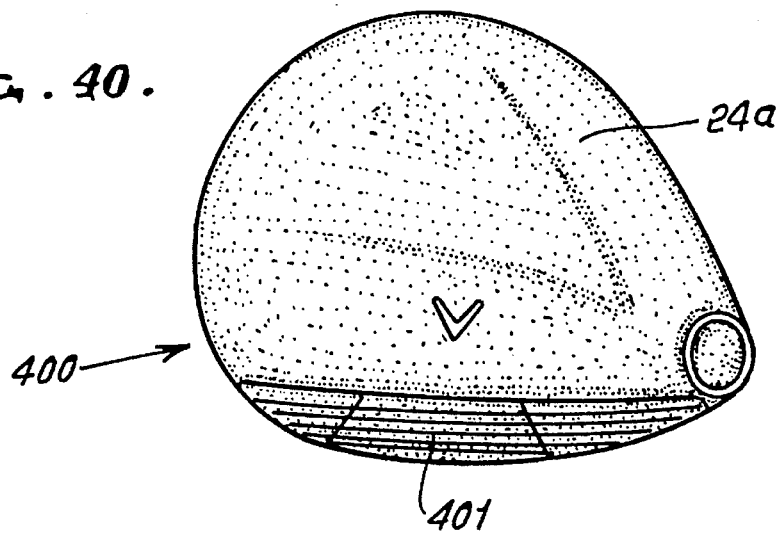
FIG. 40 is a top plan view of a golf club head, similar to the head of FIGS. 34–39, but configured as a 5 wood.
Figure 41:
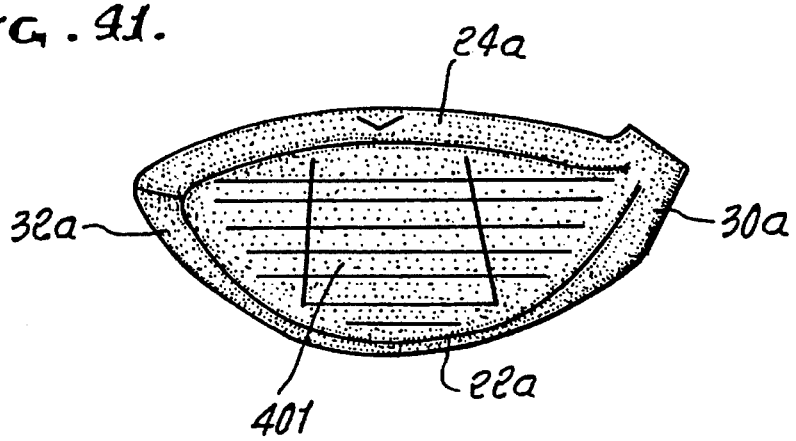
FIG. 41 is a front face elevation view of the FIG. 40 head.
Figure 42:
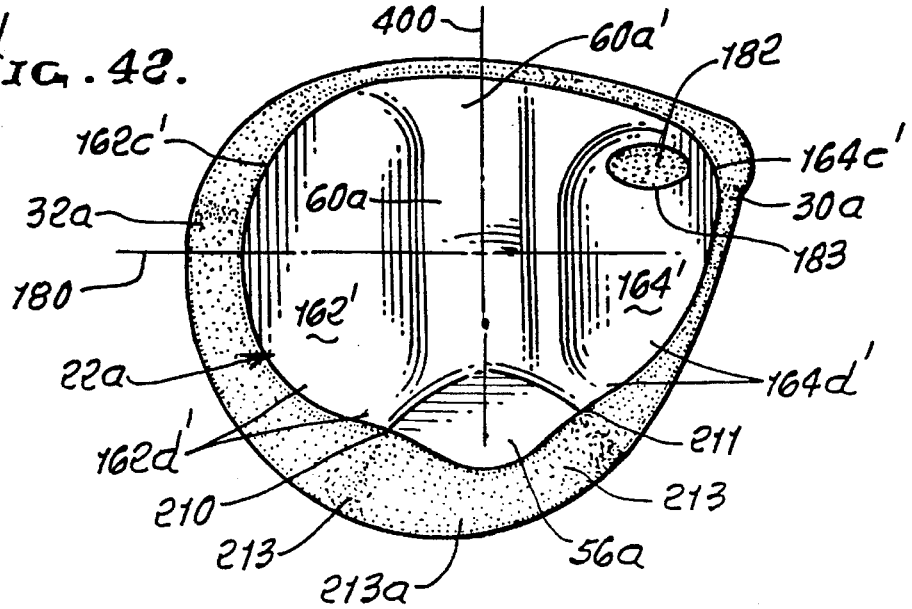
FIG. 42 is a bottom plan view of the FIG. 40 head.
Figure 43:
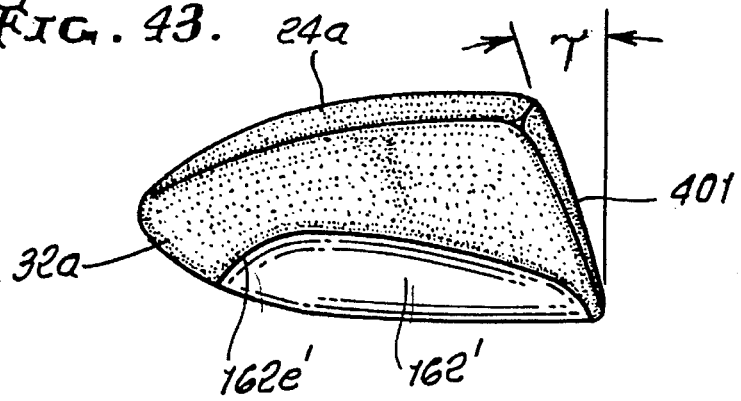
FIG. 43 is a toe end elevation view of the FIG. 40 head.
Figure 44:
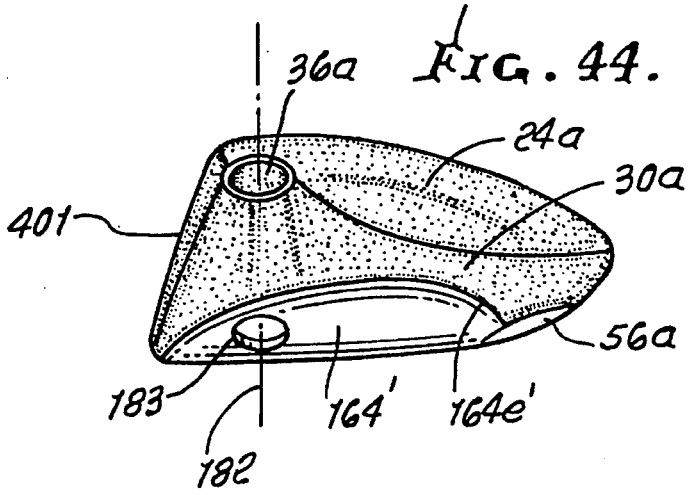
FIG. 44 is a heel end elevation view of the FIG. 40 head.
Figure 45:
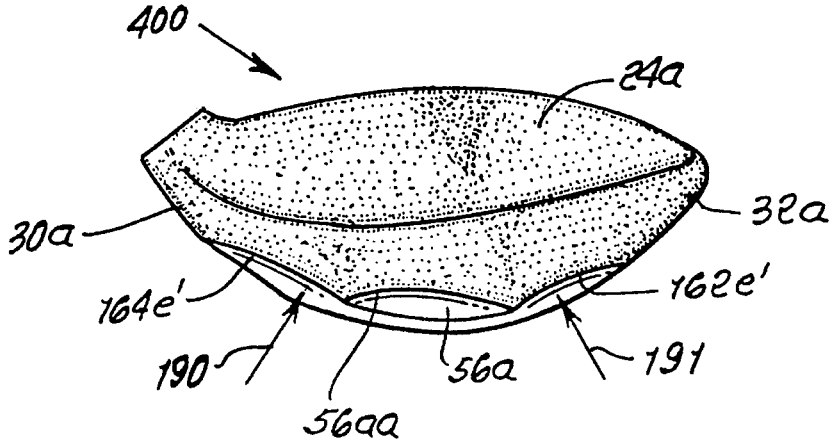
FIG. 45 is a rear elevation view of the FIG. 40 head.

Referring now to FIGS. 15–21, the metal wood head 200 shown has a front face 201 with inclination $\beta$ from vertical (see FIG. 19) which is 9°, i.e. the wood is a driver. The metal wood head 250 shown in FIGS. 22–27 is like the head of FIGS. 15–21, but the front face 251 has inclination $\gamma$ from vertical (see FIG. 26) which is 11°. The metal wood head 300 of FIGS. 28–33 is like the head of FIGS. 22–28, but the front face 301 is angled at $\Delta$ at greater than 11°, and the wood is a 2 wood. As such, it is slightly smaller in overall size than the head of FIGS. 15–27. The head 350 of FIGS. 34–39 is like the head of FIGS. 28–33, but the front face 351 has greater angular inclination at $\phi$ from vertical than the 2 wood of FIGS. 28–33, and the head 350 of FIGS. 37–39 is a 4 wood. Head 350 is slightly smaller in overall size, including height, than the head of FIGS. 28–33. Finally, the head 400 of FIGS. 40–45 is like the head of FIGS. 34–39, but its front face 401 has greater angular inclination at from vertical than the head 4 wood of FIGS. 34–39, and the head 401 is a 5 wood. Head 400 is also slightly smaller in overall size, including height, than the head 350 of FIGS. 34–39. The heads 200, 250, 300, 350 and 400 constitute a set of similar and related heads that are typically carried in a golf bag of a golfer. Note the similar configurations of the head bottom walls, which are similar to the bottom wall of the head of FIGS. 1–14.

Referring to the head 300 of FIGS. 28–33 as an example of the similar configurations of the FIG. 15–45 heads, it includes a shell having toe and heel portions 32*a* and 30*a*, a front wall 301*a* defining ball striking face 301, and top and bottom walls 24*a* and 22*a*, the ball striking faces of the heads having varying angularities with respect to vertical, the bottom wall of each head having a medial ridge 60*a*, and forming two dished, similar shallow recesses 162' and 164', one recess between the ridge and heel portion and the other recess between the ridge and toe portion. The recesses are located rearwardly of the front wall 301*a*, one recess 164' having an arcuate peripheral edge 164*a'* generally convex toward said heel portion, and the other recess 162' having an arcuate peripheral edge 162*c'* generally convex toward said toe portion. As shown, each recess 162' and 164' has a downward facing surface and is further characterized in that, for each head:

i) a vertical plane 180 bisecting the recess in a toe to heel direction intersects the recess surface along a downwardly concave line (see FIG. 46), and ii) a vertical plane bisecting each recess in a front to rear direction relative to the head intersects the recess surface along a downwardly concave line (see FIGS. 48 and 49). Further and as shown, the two recesses of each head have similar configuration (see FIG. 30) with respect to a vertical plane that bisects said ridge in a front to rear direction relative to the head. See FIG. 47.

It will also be seen that each recess has a downward facing surface, and is further characterized in that, for each head:

i) the rearwardmost extents 162*d'* and 164*d'* of said downwardly facing surfaces are inclined forwardly and upwardly relative to the head forward swing path as the head bottom wall engages the turf (see FIGS. 30, 48 and 49), ii) whereby balanced lift forces are created in response to engagement of said rearwardmost extents of said surfaces with the turf as the head is swung forwardly along said path, said lift forces acting to urge said head bottom wall and the head in an upward direction.

The medial ridge 60*a* increases in width at 60*a'* toward the front wall and between forward extents of the two recesses 162' and 164'. Beyond rearward extent of the ridge, the bottom wall has a rearwardly divergent surface 56*a* that extends rearwardly and upwardly, that surface for example being flattened, and that surface merging with the recesses at cusps that are substantially equidistant from the head front wall, contributing to balanced lift force creation. As is the case in FIGS. 10 and 11, the bottom wall 22*a* may be in part defined by a sole plate having a peripheral edge rigidly connected to the bounding edge of an opening defined by said bottom wall, whereby the sole plate closes said opening, said ridge and recesses being in part defined by the sole plate. Also, as shown in FIG. 46, and as previously described in regards to FIG. 5, there is a substantially continuous, hollow, metallic tube (as at 36 in FIG. 5) extending within the shell proximate the heel portion and from proximate the shell top wall to proximate the shell bottom wall, that tube having a bore to receive a club shaft, the bore aligned with one shallow recess. The axis of the bore intersects the shallow recess 164', as at 182, and the bore wall may intersect that recess as at 183, i.e. elliptically.

In addition, the bottom wall or sole plate 22*a* is seen to define major extents of the shallow recesses 162' and 164'; each recess has a downwardly facing surface, and said surface is downwardly concave in a front to rear direction; and each recess downwardly facing surface is also downwardly concave in a toe to heel direction.

Figure 33:
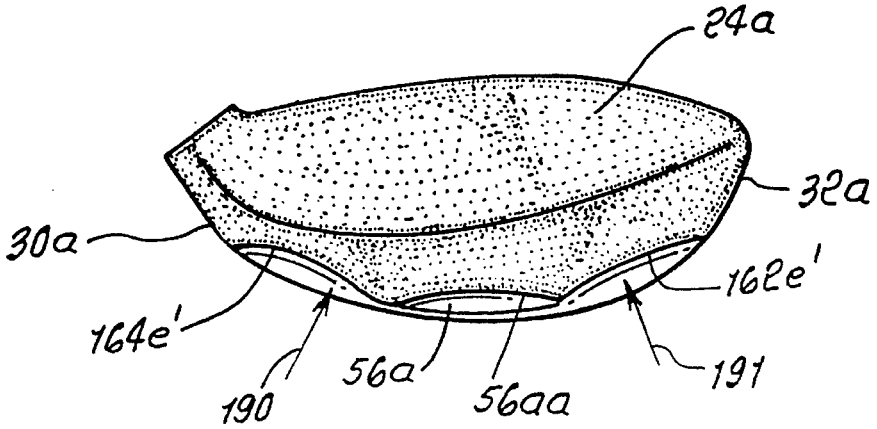
FIG. 33 is rear elevation view of the FIG. 28 head.
Figure 34:
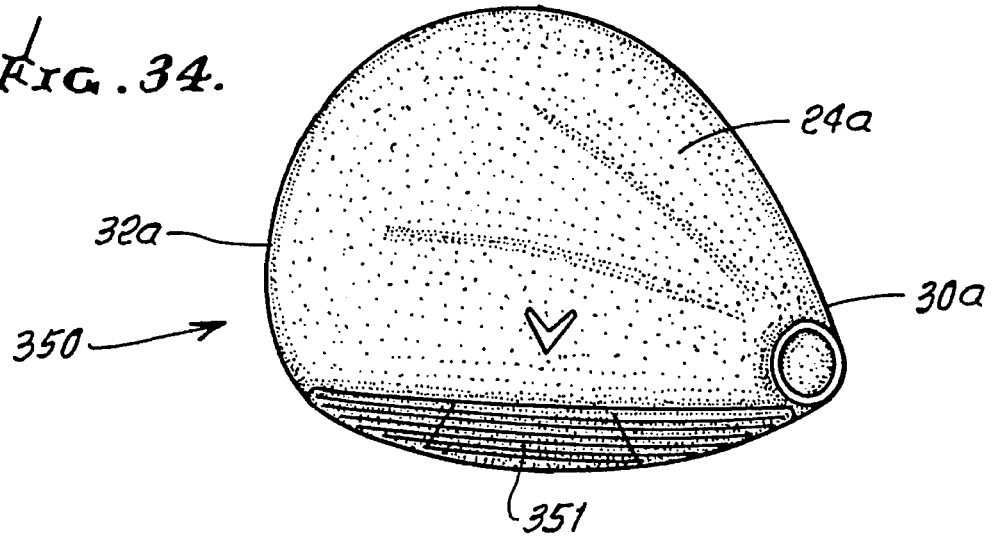
FIG. 34 is a top plan view of a golf club head, similar to the heads of FIGS. 15–33, but configured as a 4 wood.
Figure 35:
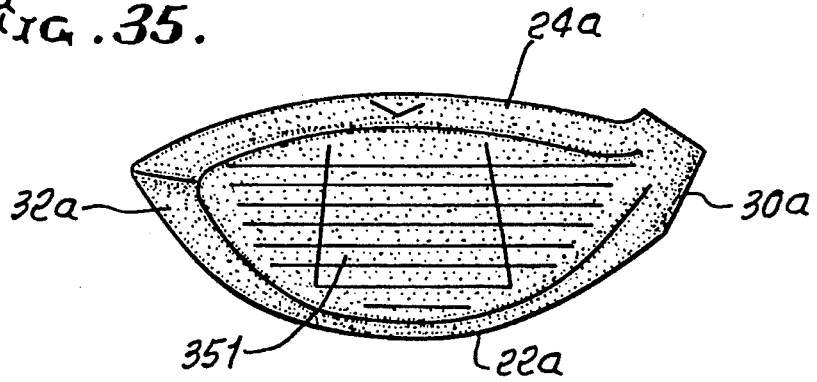
FIG. 35 is a front face elevation view of the FIG. 34 head.
Figure 36:
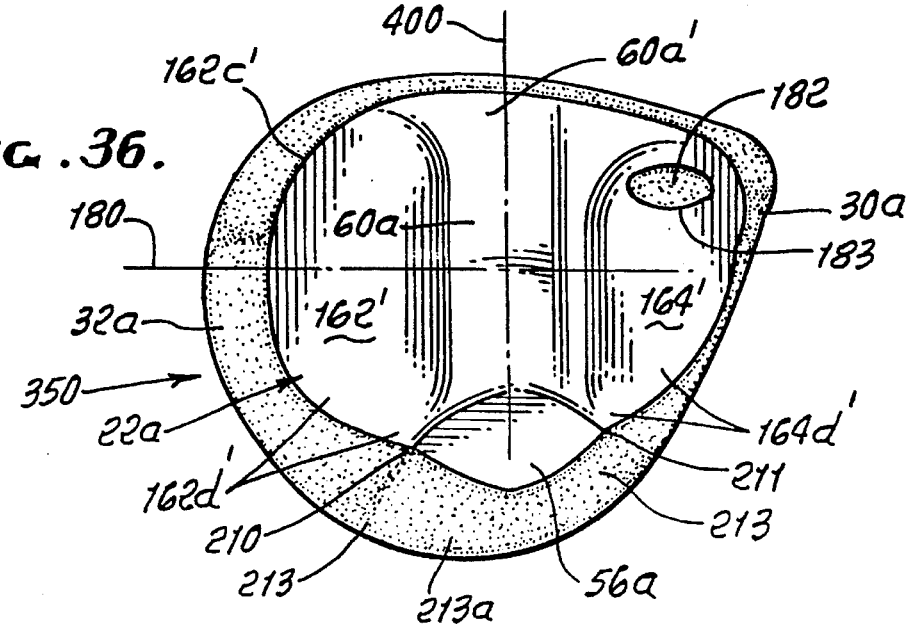
FIG. 36 is a bottom plan view of the FIG. 34 head.

Referring to FIG. 33, the recesses 162' and 164' have edges 162*e'* and 164*e'* which, when viewed from the rear of the head, are upwardly convex. The rearward edge 56*aa* of flattened beveled surface 56*a* is also upwardly convex in FIG. 33, and located approximately mid-way between edges 162*e'*and 164*e'*. Such convex edges extend in an arcuate row, as seen in FIG. 33, and define a V-shape. Upward lift force vectors appear at 190 and 191, and result from engagement of the inclined rear portions of the inclined rear portions of the dished recess surfaces with the turf, as referred to above. Note that the vectors are angled upwardly and toward one another.

Each of the heads of FIGS. 15–45 has generally the same construction, and the corresponding elements bear the same numbers. Generally speaking, it may be said that, for each head its bottom wall has upwardly dished wall extent, and which defines downwardly facing surface means inclined forwardly and upwardly relative to the head swing path as the bottom wall engages the turf, so that the turf moving relatively rearwardly engages said inclined surface means for creating lift force acting to urge the bottom wall and the head in an upward direction. The upwardly dished wall extent more specifically may define two dished shallow recesses at toe and heel sides respectively of a medial ridge, the recesses everywhere spaced rearwardly from said front wall, the one recess having an arcuate peripheral edge generally convex toward said heel portion, and the other recess having an arcuate peripheral edge generally convex toward the toe portion, said recesses being located in substantially mirror imaged positions with respect to a forwardly extending vertical plane bisecting said ridge.

The internal construction of the heads of FIGS. 15–45, may, if desired, be the same as that of the FIG. 1–14 head, as respects provision and location of dendrites reinforcing the thin-walled head structures in the manner and for reasons explained in FIGS. 1–14.

Plastic filler material in the head is shown at 196.

Referring again to FIG. 18, the head is further characterized by the following:

i) the dished recesses 162' and 164' are located in substantially mirror imaged position with respect to a forwardly extending, vertical plane 400 bisecting the ridge 60*a;* ii) the convergent rearward terminus of dished recess rearwardmost extent 162*d'* is intersected by a cusp 210 defined by surface or bevel 56*a*; and the convergent rearward terminus of dished recess rearwardmost extent 164*d'* is intersected by a cusp 211 also defined by bevel 56*a*. These cusps are further defined by intersection of the bevel with head rounded outer bottom surface 213 and intersection of the bevel with the ridge rearwardmost and rearwardmost divergent extents, as shown. The cusps 210 and 211 are substantially equidistant from the head front face 201, whereby the bevel is centered between the rearwardmost extents 162*d'* and 164*d'* of the recesses.

iii) plane 400 also bisects the bevel so that cusps 210 and 211 are located at substantially equal distances from the plane; and the plane 400 also intersects the rearwardmost extent 213*a* of the head. Note the ridge 60*a* is divergent, forwardly.

The above features, also found in FIGS. 24, 30, 36 and 42 contribute to the balanced lift force creation discussed above.

We claim:

1. A set of golf club heads, each head comprising a shell having toe and heel portions, and a front wall defining a ball striking face, and top and bottom walls, the ball striking faces of the heads having varying angularities with respect to vertical, the bottom wall of each head having a medial ridge, and forming two dished, similar shallow recesses, one recess between the ridge and heel portion and the other recess between the ridge and toe portion, said recesses located rearwardly of said front wall, one recess having an arcuate peripheral edge portion generally convex toward said heel portion and the other recess having an arcuate peripheral edge portion generally convex toward said toe portion, said ridge being forwardly elongated and having a forwardmost extent with forwardly diverging opposed surfaces diverging toward and in proximity to said front wall, rearwardmost extent with rearwardly diverging opposed surfaces diverging away from and distal from said head front wall, and a curved rearward edge convex toward and distal from said front wall.

2. The set of golf club heads as defined in claim 1, and wherein each recess of each head has a downward facing surface and is further characterized in that, for each head:

i) a vertical plane bisecting the recess in a toe to heel direction intersects the recess surface along a downwardly concave line, and ii) a vertical plane bisecting the recess in a front to rear direction relative to the head intersects the recess surface along a downwardly concave line.

3. The set of golf club heads as defined in claim 1 wherein said two recesses of each head have similar configuration with respect to a vertical plane that bisects said ridge in a front to rear direction relative to the head.

4. The set of golf club heads as defined in claim 1 wherein each recess of each head has a downward facing surface, and is further characterized in that, for each head:

i) the rearwardmost extent of said downwardly facing surface is inclined forwardly and upwardly relative to the head forward swing path as the head bottom wall engages the turf, ii) whereby lift force is created in response to engagement of said rearwardmost extent of said surface with the turf as the head is swung forwardly along said path, said lift force acting to urge said head bottom wall and the head in an upward direction.

5. The set of heads as defined in claim 1, wherein, for each head, said bottom wall thereof has a rearwardly divergent surface that extends at a rearwardly and upwardly extending angle, beyond rearward extent of said ridge, and between rearward extents of said recesses, said surface merging with rearwardmost extents of said recesses at cusps, said cusps spaced substantially equidistantly from the head front wall.

6. The set of heads as defined in claim 1, wherein, for each head, said bottom wall thereof is in part defined by a sole plate having a peripheral edge rigidly connected to the bounding edge of an opening defined by said bottom wall, whereby the sole plate closes said opening, said ridge and recesses being in part defined by the sole plate.

7. The set of heads as defined in claim 1, wherein, for each head, said front wall thereof has lowermost U-shaped configuration, forwardly of said ridge and recesses.

8. The set of heads as defined in claim 1 wherein, for each head, there is a substantially continuous, hollow, metallic tube extending within the shell of the heel portion and from proximate the shell top wall to proximate the shell bottom wall, said tube having a bore to receive a club shaft, said bore aligned with said one shallow recess.

9. The set of heads as defined in claim 1 wherein, for each head, each recess has a downwardly facing surface, and said surface is downwardly concave in a front to rear direction.

10. The set of heads as defined in claim 9, wherein, for each head: each recess downwardly facing surface is also downwardly concave in a toe to heel direction.

11. The set of heads as defined in claim 1 wherein, for each head: said bottom wall includes a sole plate peripherally connected to a shell rim defining a bottom opening, said sole plate defining major extents of said shallow recesses.

12. The set of heads as defined in claim 5 wherein said rearwardly divergent surface and said recesses have edges which, when viewed from the rear of the head, are upwardly convex.

13. The set of heads as defined in claim 12 wherein said upwardly convex edges extend in an arcuate row, as viewed from the rear of the head.

14. The set of heads as defined in claim 1 which include at least two of the following:

a) a metal wood having a front face inclined at approximately 9° from vertical, b) a metal wood having a front face inclined at approximately 11° from vertical, c) a metal 2 wood, d) a metal 4 wood, e) a metal 5 wood.

15. The set of heads as defined in claim 1 which include all of the following:

a) a metal wood having a front face inclined at approximately 9° from vertical, b) a metal wood having a front face inclined at approximately 11° from vertical, c) a metal 2 wood, d) a metal 4 wood, e) a metal 5 wood.

16. The set of heads as defined in claim 1 characterized by one of the following:

a) at least one head has a center of gravity located at approximately 42 to 50% of the head height as measured upwardly from the lowermost head surface to the uppermost head surface, viewed from the front of the head.

17. A set of golf club heads, each head in the set having top, bottom, front, rear, toe, and heel walls, the front walls of the heads having differently inclined ball striking faces, a) said bottom wall having upwardly dished wall extent, b) said upwardly dished wall extent defining downward facing surface means inclined forwardly and upwardly relative to the head swing path as the bottom wall engages the turf, so that the turf moving relatively rearwardly engages said inclined surface means for creating lift force acting to urge the bottom wall and the head in an upward direction, c) said upwardly dished wall extent defining first and second recesses, and d) a medial ridge between said first and second recesses, said ridge being forwardly elongated and having a forwardmost extent with forwardly diverging opposed surfaces diverging toward and in proximity to said front wall, rearwardmost extent with rearwardly diverging opposed surfaces diverging away from and distal from said head front wall, and a curved rearward edge convex toward and distal, from said front wall.

18. The club head of claim 7 wherein there are two dished extents each defining a portion of said inclined surface means whereby upward lift forces are developed at opposite sides of said ridge.

19. A golf club head comprising a shell having toe and heel portions, a front wall defining a ball-striking face, and top and bottom walls, said bottom wall characterized as having a medial ridge, and as forming two dished shallow recesses, one recess between the ridge and the heel portion, and the other recess between the ridge and the toe portion, said recesses everywhere spaced rearwardly from said front wall, the one recess having an arcuate peripheral edge generally convex toward said heel portion, and the other recess having an arcuate peripheral edge generally convex toward the toe portion, said recesses located at opposite sides of a forwardly extending vertical plane bisecting said ridge, the ridge being forwardly elongated and having a forwardmost extent with forwardly diverging wall surfaces located respectively at opposite sides of said plane, said diverging wall surfaces diverging toward and in proximity to said head front wall, the ridge having a rearwardmost extent with rearwardly diverging wall surfaces at opposite sides of said plane, there being a curved rearward edge between said rearwardly diverging wall surfaces, said curved rearward edge being convex toward and distal from said front wall, the ridge having a bottom surface extending forwardly and rearwardly at substantially the same level between said ridge forwardmost extent and said convex rearward edge.

20. The club head of claim 19 wherein said bottom wall has a rearwardly divergent surface that extends at a rearwardly and upwardly extending angle, beyond rearward extent of said ridge, and between rearward extents of said recesses.

21. The club head of claim 20 wherein said recesses have downward facing surfaces with shallow upwardly dished configuration.

22. The club head of claim 19 wherein said bottom wall is in part defined by a sole plate having a peripheral edge rigidly connected to the bounding edge of an opening defined by said bottom wall, whereby the sole plate closes said opening, said ridge and recesses being in part defined by the sole plate.

23. The club head of claim 19 wherein said recesses have surfaces that merge in arcuate relation with opposite sides of said ridge.

24. The club had of claim 19 wherein said front wall has lowermost U-shaped configuration, forwardly of said ridge and recesses.

25. The club head of claim 19 having a substantially continuous, hollow, metallic tube extending within the shell of the heel portion and from proximate the shell top wall to proximate the shell bottom wall, said tube having a bore to receive a club shaft, said bore aligned with said one shallow recess.

26. The club head of claim 21 wherein said downward facing surfaces are concave in front-to-rear directions.

27. The club head of claim 26 wherein said downward facing surfaces are also concave in directions between the heel and toe.

28. The club head of claim 19 wherein said bottom wall includes a sole plate peripherally connected to a shell rim defining a bottom opening, said sole plate defining major extents of said shallow recesses.

29. The club head of claim 20 wherein said bottom wall includes a sole plate peripherally connected to a shell rim defining a bottom opening, said sole plate defining major extents of said shallow recesses, said sole plate also defining said ridge and said rearwardly divergent surface.

30. The club head of claim 25 wherein said bottom wall includes a sole plate peripherally connected to a shell rim defining a bottom opening, said sole plate defining major extents of said shallow recesses, said shell defining a bottom wall corner plate section integral with said tube, said sole plate also connected to said corner plate section, said corner plate section forming a portion of said one shallow recess between said ridge and heel portion.

31. The club head of claim 19 including a first group of narrow, metallic, shock wave distributing dendrites extending from said front wall generally rearwardly adjacent the underside of the shell top wall and integral therewith, said dendrites projecting toward said two shallow recesses.

32. The club head of claim 31 including a second group of dendrites integral with said top wall and which are spaced apart, and which extend generally rearwardly to merge rearwardly and downwardly with a rear wall defined by the shell to transfer rearward loading from said top wall in response to front wall impact with a golf ball, said second group of dendrites also projecting toward said two shallow recesses.

33. The club head of claim 32 wherein the dendrites of each group are spaced apart in a toe-to-heel direction.

34. A golf club head having a metal shell defining top, bottom, front, rear, toe, and heel walls, and including a) dendrites integral with the inner sides of said top and rear walls, and b) the bottom wall having two upwardly dished wall sections projecting toward the dendrites integral with the top wall, and spaced between the heel and toe, said dished wall sections defining first and second recesses, c) said dished sections located in substantially mirror imaged relation with respect to a vertical plane bisecting the head mid-way between the recesses, d) there being a medial ridge formed between the first and second recesses, said ridge being forwardly elongated and having a forwardmost extent with forwardly diverging opposed surfaces diverging toward and in proximity to said front wall, rearwardmost extent with rearwardly diverging opposed surfaces diverging away from and distal from said head front wall, and a curved rearward edge convex toward and distal from said front wall.

35. A club head of claim 19 wherein the ridge is downwardly convex rearwardly of said front wall and co-acts with said recesses during a club stroke to direct the turf toward and into the recesses, the recesses having surfaces inclined forwardly and upwardly to be engaged by the turf moving relatively rearwardly, for creating lift forces at opposite sides of the ridge, urging the bottom wall and head in an upward direction.

36. The head of claim 19 wherein the head has a center of gravity located at approximately 42 to 50% of the head height as measured upwardly from the lowermost head surface to the uppermost head surface, viewed from the front of the head.

37. The head of claim 20 wherein the head has a center of gravity located at approximately 42 to 50% of the head height as measured upwardly from the lowermost head surface to the uppermost head surface, viewed from the front of the head.

38. The club head of claim 20 wherein said rearwardly divergent surface has edges which project divergently rearwardly.

39. In the method of forming golf club heads in a set, each head having top, bottom, front, rear, toe and heel walls, the steps that include:

a) forming the bottom wall of each head to have upwardly dished wall extent, b) forming said upwardly dished wall extent of each head to have downwardly facing surface means inclined forwardly and upwardly relative to the head swing path as the bottom wall engages the turf, c) and forming said front walls of the heads of the set to have differently inclined ball striking faces, d) said surface means formed to define two recesses and an intermediate ridge formed between said first and second recesses, said ridge being forwardly elongated and having a forwardmost extent with forwardly diverging opposed surfaces diverging toward and in proximity to said front wall, rearwardmost extent with rearwardly diverging opposed surfaces diverging away from and distal from said head front wall, and a curved rearward edge convex toward and distal from said front wall.

40. The method of claim 39 including forming said walls as integrally connected thin metal walls.

41. The method of claim 39 wherein said bottom wall is also formed to have a downward facing medial ridge which extends generally forwardly, said dished wall extent formed to include two dished extents defining portions of said inclined surface means whereby upward lift forces are developed at opposite sides of said ridge.

42. In a golf club head having a shell and defining top, bottom, front, rear, toe and heel walls, and a shell interior, the combination that includes:

a) the bottom wall having upwardly dished wall extent, b) said upwardly dished wall extent having downwardly facing surface means inclined forwardly and upwardly relative to the head swing path as the bottom wall engages the turf, c) the head having a club shaft-receiving hosel having an axis that projects to intersect said dished wall extent, d) said bottom wall also having a downward facing medial ridge which protrudes downwardly and extends generally forwardly, said dished wall extent including two dished extents defining first and second recesses at opposite sides of said ridge, e) said medial ridge being forwardly elongated and having a forwardmost extent with forwardly diverging opposed surfaces diverging toward and in proximity to said front wall, rearwardmost extent with rearwardly diverging opposed surfaces diverging away from and distal from said head front wall, and a curved rearward edge convex toward and distal from said front wall.

43. A golf club head comprising a shell having toe and heel portions, a front wall defining a ball-striking face, and top and bottom walls, said bottom wall characterized as having:

a) a first shallow recess proximate said heel portion everywhere spaced rearwardly from said front wall and having an arcuate peripheral edge generally convex toward said heel portion, b) a second shallow recess proximate said toe portion everywhere spaced rearwardly from said front wall and having an arcuate peripheral edge generally convex toward said toe portion, and c) a medial ridge between said first and second recesses, said ridge being forwardly elongated and having a forwardmost extent with forwardly diverging opposed surfaces diverging toward and in proximity to said front wall, rearwardmost extent with rearwardly diverging opposed surfaces diverging away from and distal from said head front wall, and a curved rearward edge convex toward and distal from said front wall.

44. The golf club head of claim 43 further comprising a trailing surface on said bottom wall rearward of said ridge, said trailing surface extending generally above said ridge rearward.

45. The golf club head of claim 43 wherein said trailing surface is generally planar and extends at an angle upwardly and rearwardly from said ridge rearward.

* * * * *

UNITED STATES PATENT AND TRADEMARK OFFICE

CERTIFICATE OF CORRECTION

PATENT NO. : 5,480,152

DATED : January 2, 1996

INVENTOR(S) : Glenn H. Schmidt &
Richard C. Helmstetter

It is certified that error appears in the above-indentified patent and that said Letters Patent is hereby corrected as shown below:

Column 18, line 10, change "43" to --44--.

Signed and Sealed this

Seventh Day of January, 1997

*Attest:*

Bruce Lehman

BRUCE LEHMAN

*Attesting Officer*

*Commissioner of Patents and Trademarks*